US006658983B2

(12) United States Patent
Kazyaka et al.

(10) Patent No.: US 6,658,983 B2
(45) Date of Patent: Dec. 9, 2003

(54) GUN MUFFLER AND NOISE ABATEMENT SYSTEM FOR LARGE CALIBER GUN

(75) Inventors: Raymond P. Kazyaka, Greenfield Center, NY (US); Raymond J. Kazyaka, Scotia, NY (US)

(73) Assignee: Wright-Malta Corporation, Ballston, NY (US)

( * ) Notice: Subject to any disclaimer, the term of this patent is extended or adjusted under 35 U.S.C. 154(b) by 0 days.

(21) Appl. No.: 10/116,287

(22) Filed: Apr. 4, 2002

(65) Prior Publication Data

US 2003/0188630 A1 Oct. 9, 2003

(51) Int. Cl.[7] ..... F41A 21/30
(52) U.S. Cl. ..... 89/14.4; 73/167; 181/223
(58) Field of Search ..... 89/14.4, 14.6; 73/167; 181/223, 225

(56) References Cited

U.S. PATENT DOCUMENTS

| | | | | |
|---|---|---|---|---|
| 883,077 A | | 3/1908 | Baker | |
| 1,017,003 A | | 2/1912 | Kenney | |
| 1,207,264 A | | 12/1916 | Bailey | |
| 1,462,158 A | | 7/1923 | Wildner | |
| 2,208,093 A | | 7/1940 | Brown | |
| 2,798,743 A | | 7/1957 | Olesten | |
| 3,120,877 A | | 2/1964 | Morris et al. | |
| 3,693,432 A | | 9/1972 | Stewart et al. | |
| 3,710,679 A | | 1/1973 | Werbell, III | |
| 4,445,693 A | | 5/1984 | Angwin | |
| 4,733,751 A | | 3/1988 | Piesik | |
| 4,907,488 A | | 3/1990 | Seberger | |
| 5,121,671 A | | 6/1992 | Coburn | |
| 5,357,796 A | | 10/1994 | Jamison | |
| 5,461,962 A | | 10/1995 | Krumm et al. | |
| 5,477,733 A | | 12/1995 | Duarte | |
| 5,610,360 A | | 3/1997 | Kazyaka et al. | |
| 5,686,688 A | | 11/1997 | Kazyaka et al. | |
| 6,079,311 A | * | 6/2000 | O'Quinn et al. | 89/14.4 |

FOREIGN PATENT DOCUMENTS

| | | | | |
|---|---|---|---|---|
| DE | 0077843 A | * | 8/1919 | 89/14.4 |
| GB | 8153 | | 5/1884 | |
| GB | 498775 | | 1/1939 | |
| GB | 1016570 | | 1/1966 | |
| GB | 2287780 A | * | 9/1995 | F41A/21/30 |
| GB | 2288007 A | * | 10/1995 | F41A/21/30 |

OTHER PUBLICATIONS

"Navy Can Silence a Howitzer If It Really Wants to Be Neighborly," *Washington Post and Times Herald*, p. A3, Saturday, Oct. 19, 1957.

Schwager, "The Muzzle Brake", The Coast Artillery Journal, pp. 32–36, May/Jun. 1945.

Fansler et al., "Attenuation of Muzzle Blast", Figs. 1–16 and 6 pages of text, Oct. 1987.

* cited by examiner

*Primary Examiner*—Charles T. Jordan
*Assistant Examiner*—John W. Zerr
(74) *Attorney, Agent, or Firm*—RatnerPrestia

(57) ABSTRACT

A gun muffler and a noise abatement system for a large caliber gun having a gun tube include a catcher. The catcher, which is disposed within the pressure vessel for entrapping particulates and for permitting the projectile to pass, includes a plurality of columns adapted for being removably attached within a pressure vessel. The gun muffler includes a transition section fitted around the gun tube and engaging the gun tube for preventing the escape of residual combustion gases caused by the firing of a projectile by the gun. Attached to the transition section is at least one pressure vessel which defines a pressure chamber for containing residual combustion gases and attenuating pressure waves. The noise abatement system includes a horizontal concrete slab and a gun muffler, as that described above, adapted for being mounted on the concrete slab.

29 Claims, 22 Drawing Sheets

PRIOR ART'

GUN MUFFLER AND NOISE ABATEMENT SYSTEM FOR LARGE CALIBER GUN

FIELD OF THE INVENTION

The present invention relates to a gun muffler and a system for minimizing the noise generated by the firing of a large caliber gun and, when desired, for stopping a projectile fired by the gun.

BACKGROUND OF THE INVENTION

Due to the increased population in the world, the noise generated by the testing of large caliber weapon systems in communities located near testing facilities of such weapon systems is becoming an increasing problem. As a result of this concern, there has been a need for a gun muffler or system for attenuating the generated noise level. Preferably, such a system should be able to rapidly and safely attenuate the noise generated by the firing of a projectile by a large caliber gun.

When a firing range has limited space, it is desirable to cause the projectile fired by a gun to be stopped a short distance from the firing of the gun. Accordingly, a system for attenuating the generated noise level should also preferably be capable of stopping a projectile fired by the gun.

U.S. Pat. No. 5,686,688, which is incorporated herein by reference, discloses a noise abatement system for a large caliber gun. The noise abatement system includes a gun muffler and a projectile stop, both of which are mounted on a concrete slab. The gun muffler may include a sabot catcher that is disposed within one of the pressure vessels for entrapping particulates caused by the firing of a gun. The catcher may be made of any suitable material for permitting gas to pass through but for preventing the passage of particulates. An example of the catcher is cables woven together as a sabot catcher.

SUMMARY OF THE INVENTION

The present invention is directed to a gun muffler and a noise abatement system for minimizing the noise generated by a firing of a large caliber gun having a gun tube.

The gun muffler includes a transition section fitted around the gun tube and engaging the gun tube for preventing the escape of residual combustion gases caused by the firing of a projectile by the gun. Attached to the transition section is at least one pressure vessel which defines a pressure vessel chamber for containing residual combustion gases and attenuating pressure waves. A catcher is disposed within the pressure vessel for entrapping particulates and for permitting the projectile to pass, and includes a plurality of columns adapted for being removably attached within the pressure vessel.

The noise abatement system includes a horizontal concrete slab and a gun muffler, as that described above, adapted for being mounted on the concrete slab. The noise abatement system may further include a projectile stop, mounted on the concrete slab and longitudinally aligned with the gun muffler, for stopping the projectile fired by the gun and for permitting the projectile to pass. As discussed above, a catcher is disposed within the pressure vessel for entrapping particulates and for permitting the projectile to pass, and includes a plurality of columns adapted for being removably attached within the pressure vessel.

BRIEF DESCRIPTION OF THE DRAWINGS

The invention is best understood from the following detailed description when read in connection with the accompanying drawings, in which.

DETAILED DESCRIPTION OF THE INVENTION

The present invention is directed to a gun muffler and a noise abatement system for a large caliber gun having a gun tube. As used herein, a "large caliber gun" refers to a gun having the size of at least 155 mm. Although a muffler used with the present invention could be made for smaller guns, for example, as low as 30 mm, it is normally not needed to muffle the noise generated from such smaller guns. With a gun muffler used with the present invention, the noise level is attenuated by 30% at 100 yards from the firing of the gun and by 95% at 300 yards from firing of the gun.

Figure 23:
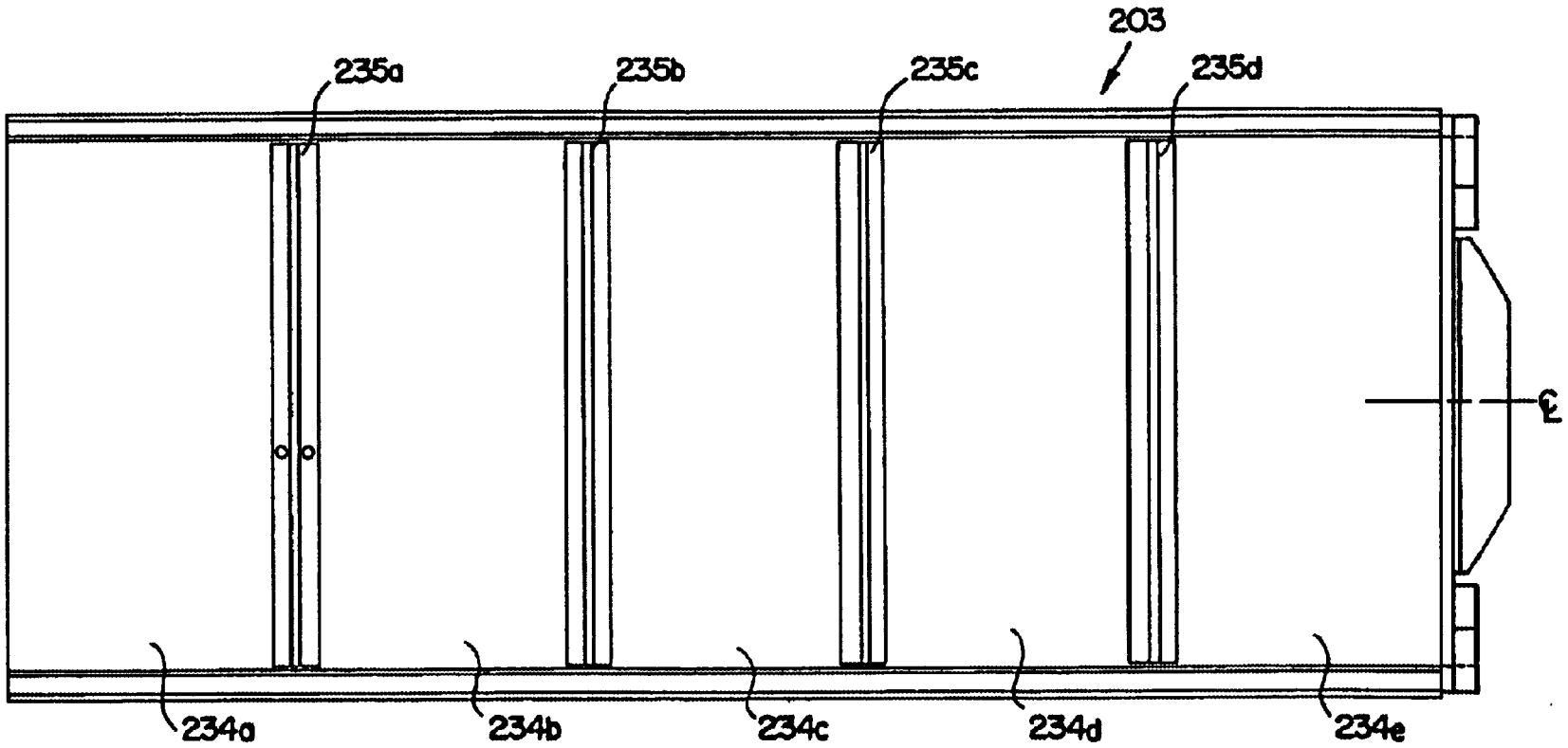
FIG. 23 PRIOR ART
FIG. 23 is top plan view of the projectile stop shown in FIG. 15.
Figure 24:
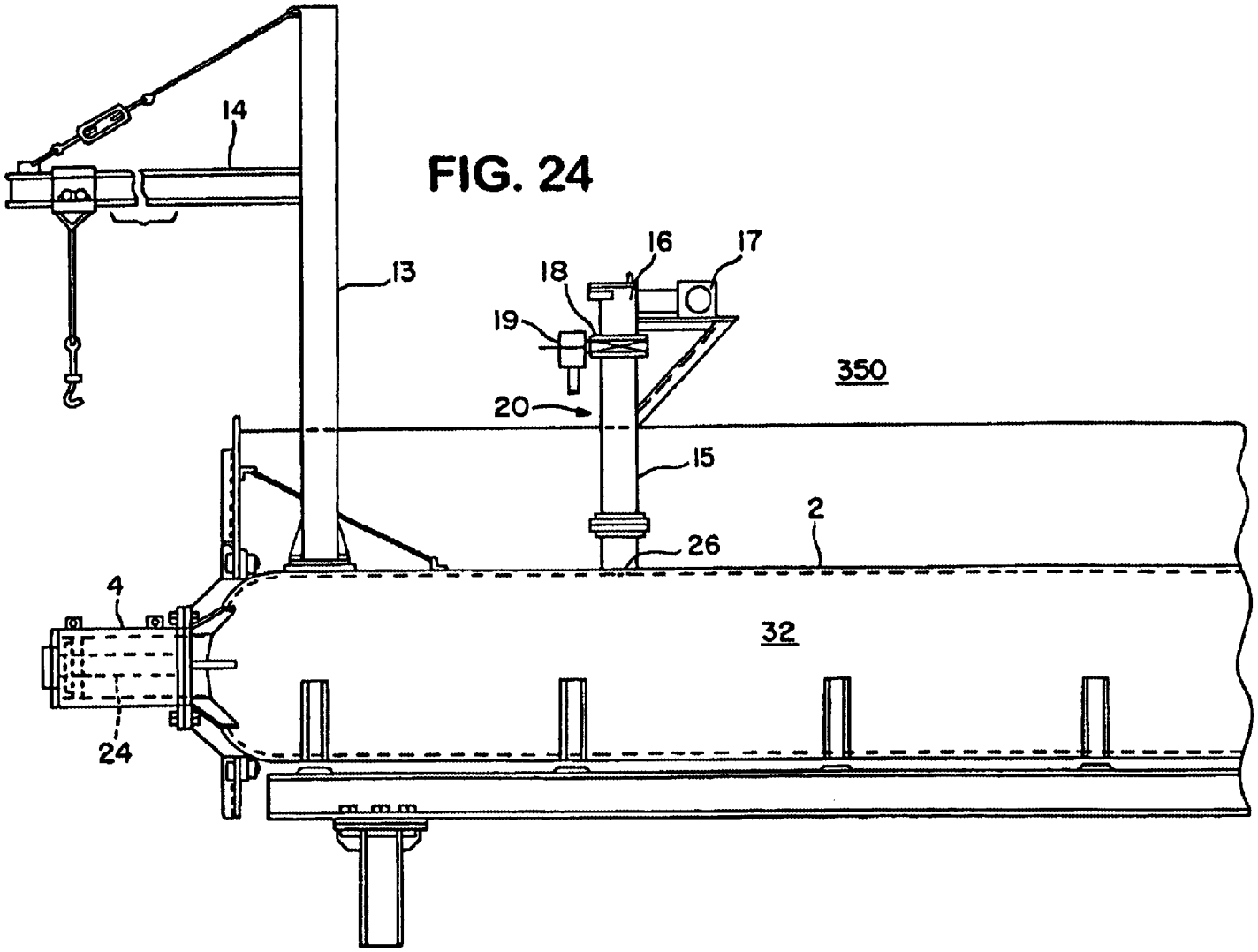
FIG. 24 is a fragmentary longitudinal side elevational view of the left portion of another embodiment of a gun muffler used with the present invention.
Figure 25:
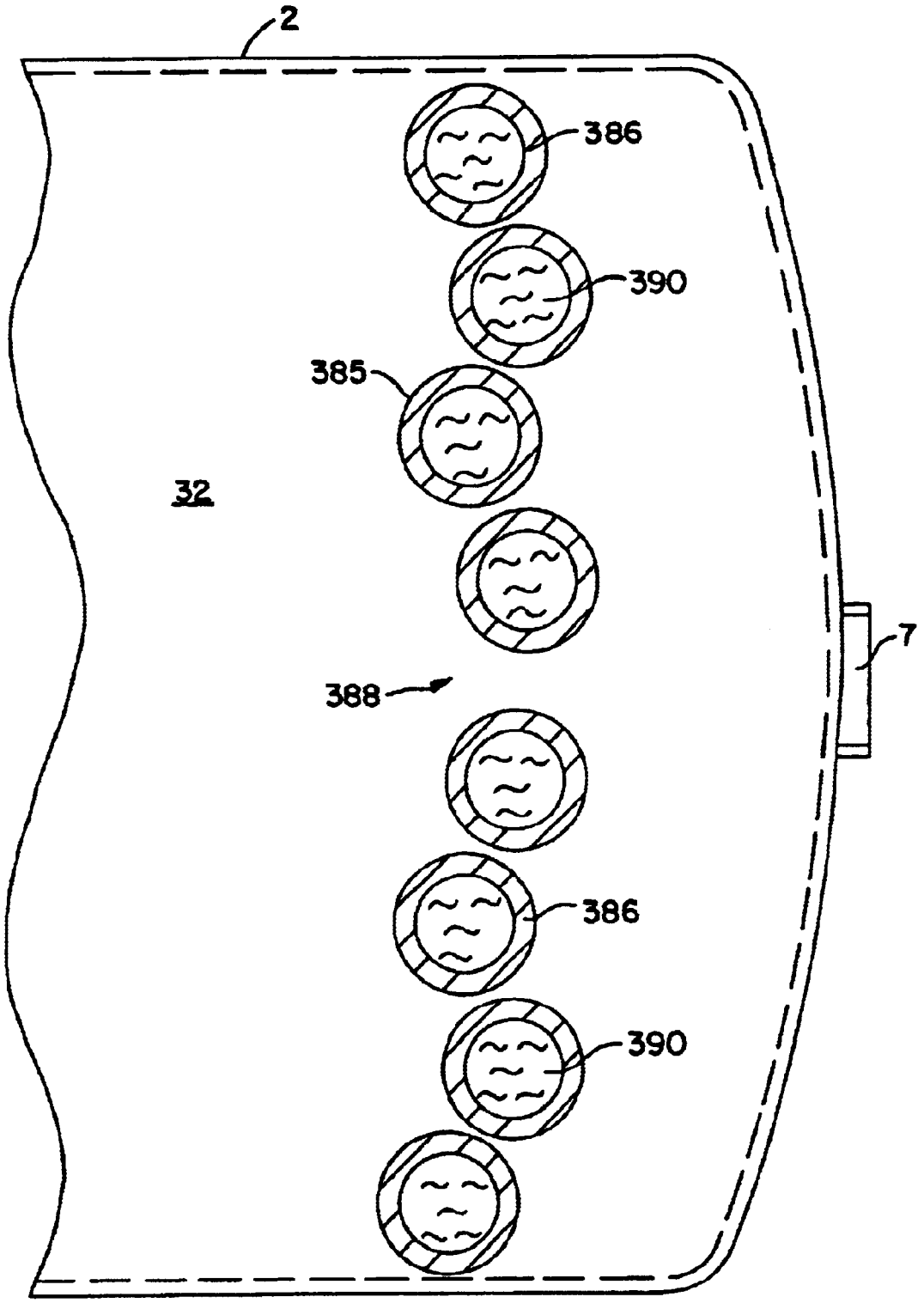
FIG. 25 is a fragmentary top sectional view, showing an arrangement of a sabot catcher within the main pressure vessel of the gun muffler of FIG. 24, taken along the line 25—25 of FIG. 24A.

Referring to FIGS. 24–25, a gun muffler 350 in accordance with an embodiment of the present invention is shown. In addition to comprising a sabot catcher 385, the gun muffler 350 can comprise some or all of the features from a gun muffler 50 discussed below in connection with FIGS. 1–9, a gun muffler 150 discussed below in connection with FIGS. 10–14, or a gun muffler 250 discussed below in connection with FIGS. 15–23. These systems are also described in U.S. Pat. No. 5,686,688, which is incorporated herein by reference. Alternatively, the gun muffler 350 can comprise a combination of features from the gun mufflers 50, 150, 250. As an example of an embodiment and for simplicity reasons, FIGS. 24–25 show the gun muffler 350 comprising the sabot catcher 385 in relation to the gun muffler 50 discussed below in connection with FIGS. 1–9. The gun muffler 350 serves to attenuate pressure waves caused by a firing of a projectile of a gun, and the sabot catcher 385 is adapted for entrapping particulates and for permitting the projectile to pass through.

Figure 1:
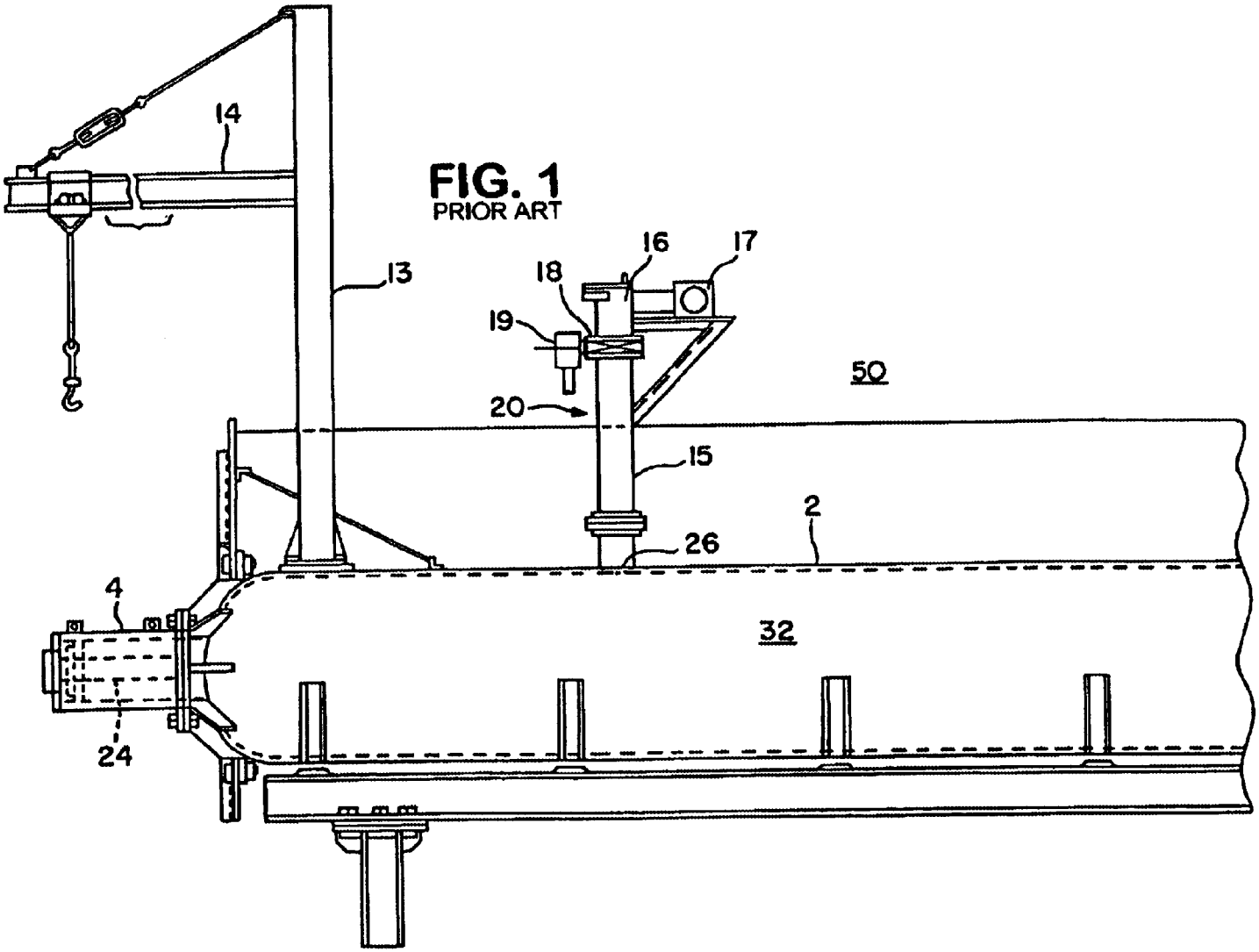
FIG. 1 PRIOR ART
FIG. 1 is a fragmentary longitudinal side elevational view of the left portion of a first embodiment of a gun muffler used with the present invention.
Figure 1A:
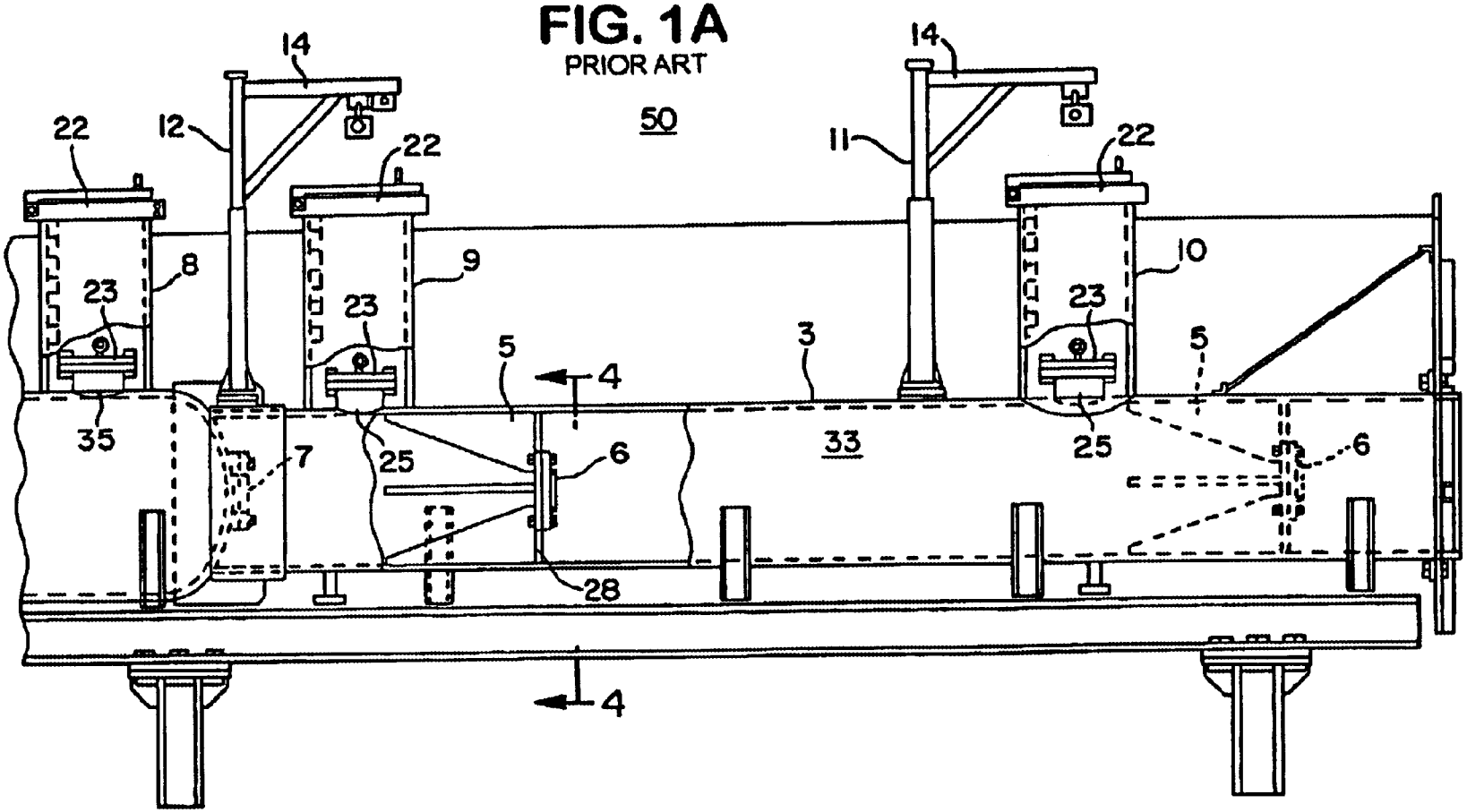
FIG. 1A PRIOR ART
FIG. 1A is a fragmentary longitudinal side elevational view of the right portion of the gun muffler shown in FIG. 1.

Referring to FIGS. 1 and 1A, the gun muffler 50 includes a transition section 4 which fits around the gun tube 24 and engages the gun tube for preventing the escape of residual combustion gases caused by a firing of the gun. At least one pressure vessel is attached to the transition section 4. As shown in FIGS. 1 and 1A, the pressure vessels include a main pressure vessel 2 defining a main pressure chamber 32 and an extension pressure vessel 3 defining an extension pressure chamber 33. Extension pressure vessel 3 is disposed in series with and connected to main pressure vessel 2. The two pressure vessels 2, 3 may be bolted together.

As shown, the main pressure vessel 2 and the extension pressure vessel 3 are generally cylindrical. In one embodiment, the main pressure vessel 2 is about 4,000 cubic feet (9 feet in diameter and 64 feet long) and the extension pressure chamber 33 is approximately 1,000 cubic feet.

The main pressure vessel 2 includes a port 26. A vent stack 20 is coupled to the main pressure vessel 2 at the port 26 and includes a lower vent stack 15 and an upper vent stack 16. The lower vent stack 15 is in permanent fluid communication with the main pressure chamber 32 by way of the port 26. Disposed in the upper vent stack 16 is an exhaust blower 17. The exhaust blower 17 should be capable of rapidly creating a vacuum in the main pressure chamber 32 and the extension pressure chamber 33 for venting residual combustion gases from these chambers 32, 33 to the atmosphere by way of the port 26. The blower 17 may be a squirrel-cage blower having drum type blowers or vanes.

Disposed in the vent stack 20 is a valve 18, which separates the upper vent stack 16 from the lower vent stack 15. Accordingly, the valve 18 is disposed between the main pressure chamber 32 and the exhaust blower 17. The valve 18 is actuated by actuator 19, which is air-operated. The valve 18 should be capable of withstanding high pressure, for example, pressure above 600 psi.

According to an embodiment of the invention, the valve 18 is a commercially available butterfly valve having a twenty-four inch diameter through the port 26 and is capable of operating at 1,000 psig. Also, the actuator 19 can be a pneumatic actuator which operates at 100 psig and is controlled by an electrically operated solenoid valve. The valve 18 is operated to be closed during firings of the gun and opened between firings of the gun.

At the end of the main pressure vessel 2 which is coupled to the extension pressure vessel 3 is an orifice plate 7. The orifice plate 7 is an annular disk defining a central circular hole through which the projectile passes. The size of the hole is dictated by the size of the projectile. Also, if the hole is too small, it is difficult to rapidly vent the extension pressure chamber 33 through the hole and out through the port 26 by way of the exhaust blower 17. On the other hand, if the hole of the orifice plate 7 is too large, the muffling of sound is not sufficient. It has been found that for a projectile of 155 mm, the orifice plate 7 should have a hole of about ten inches in diameter.

Figure 4:
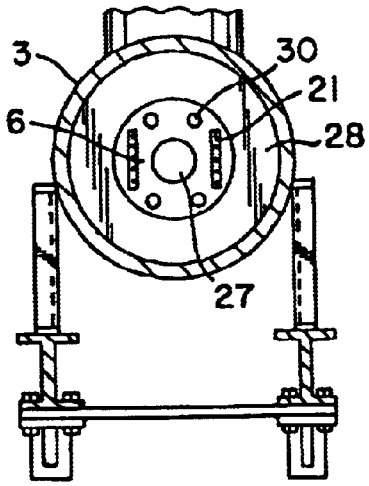
FIG. 4 PRIOR ART
FIG. 4 is a fragmentary transverse vertical sectional view, showing the orifice plate, taken along the line 4—4 of FIG. 1A.

As shown in FIG. 1A, two baffle and orifice assemblies are disposed in series in the extension pressure chamber 33. These energy-absorbing baffle and orifice assemblies each comprise a baffle 5 and an orifice plate 6. Baffles 5 are generally conical in shape, having a diameter which linearly decreases from the entry end of the extension pressure chamber 3 to the exit end of the extension pressure chamber 3. The baffle 5 abuts against the orifice plate 6, which is also shown in FIG. 4. A retaining wall 28 is coupled to the extension pressure chamber 3, and the orifice plate 6 is mounted to the retaining wall 28 by way of straps 21 and nuts and bolts 30. Similar to the orifice plate 7, the orifice plate 6 defines a central hole 27 through which a projectile passes. The diameter of the hole 27 is defined by similar functional requirements as the diameter of the hole of the orifice plate 7.

Also shown in FIG. 1A and are vent/access stacks 8, 9, 10. The vent/access stacks 8, 9, 10 include stack covers 22, which could be mounted by way of a hinge to the vent/access stacks. Each vent/access stack covers an access cover 23 which is mounted over an access port 25, 35. The access ports 25 are in communication with the extension pressure chamber 33, and the access port 35 is in communication with the main pressure chamber 32. The purpose of these access stack assemblies is to permit personnel to enter into the main pressure chamber 32 or the extension pressure chamber 33 for maintenance or repair.

Because of the size and weight of the parts of the vent/access stacks 8, 9, 10 cranes 11, 12, each having crane arms 14, are used to remove and replace the stack covers 22 and the access covers 23. Furthermore, crane 13, having crane arm 14, is used to remove and mount the transition section 4.

Figure 2:
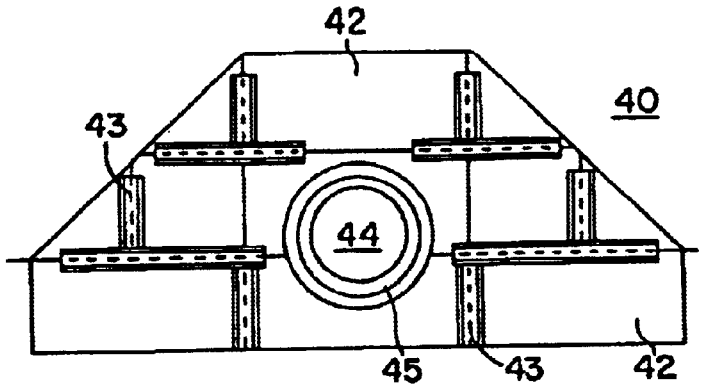
FIG. 2 PRIOR ART
FIG. 2 is an elevational view of the reinforced left-end plate of the gun muffler.
Figure 3:
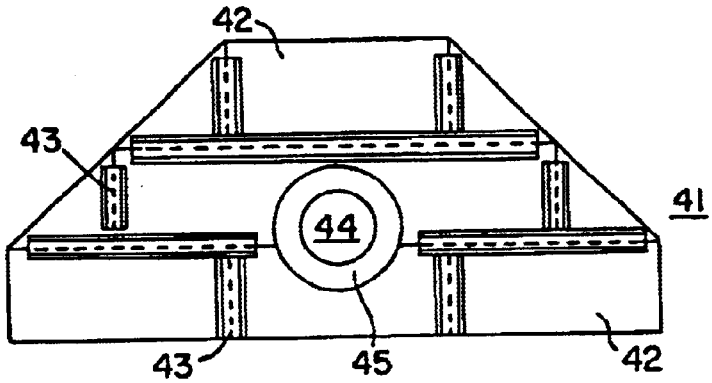
FIG. 3 PRIOR ART
FIG. 3 is an elevational view of the reinforced right-end plate of the gun muffler.

FIGS. 2 and 3 show respectively the left-end plate 40 and right-end plate 41 of the present invention. Each end plate 40, 41 includes individual plates 42 which are connected to one another by connector beams 43. Each end plate 40, 41 defines a central hole 44. Preferably, each end plate 40, 41 includes removable annular disks 45 so that the diameter of the central hole 44 can be changed to accommodate various sizes of guns.

The left-end plate 40 is placed vertically at the entry end of the transition section 4. A gun tube is pushed through the central hole 44 and into the transition section 4. Preferably, the innermost removable annular disk 45 sealingly engages the gun tube.

The right-end plate 41 is placed on the exit end of the extension pressure chamber 3. A supplemental tube is placed through the central hole 44. Preferably, the innermost annular disk 45 sealingly engages the supplemental tube.

The purpose of the left-end plate 40 and the right-end plate 41 is to retain sand so that the main pressure vessel 2 and the extension pressure vessel 3 can be entirely covered in sand during operation. By covering the muffler 50 in sand, the muffling effect is increased, although the muffler need not be covered in sand.

Figure 5:
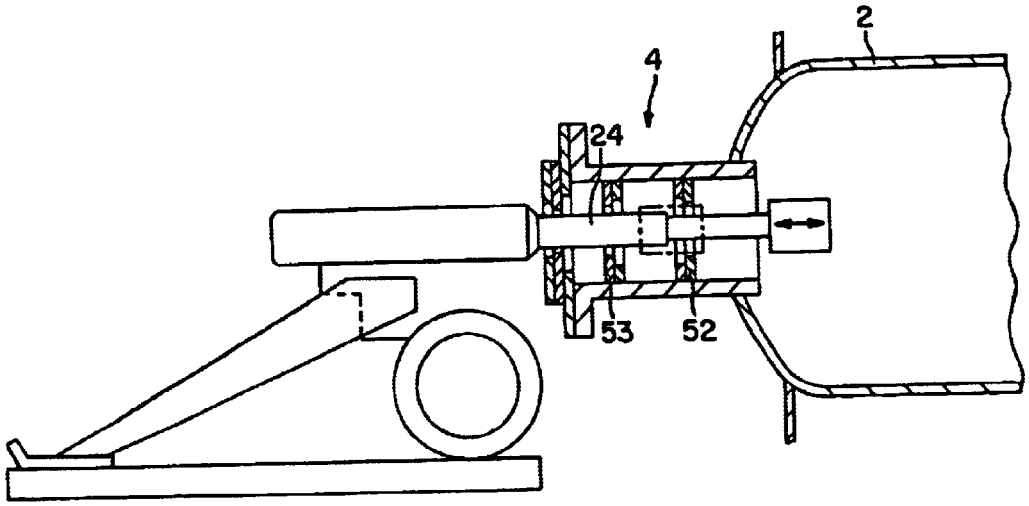
FIG. 5 PRIOR ART
FIG. 5 is a fragmentary side elevational view of a gun and gun muffler, partly in section.
Figure 6:
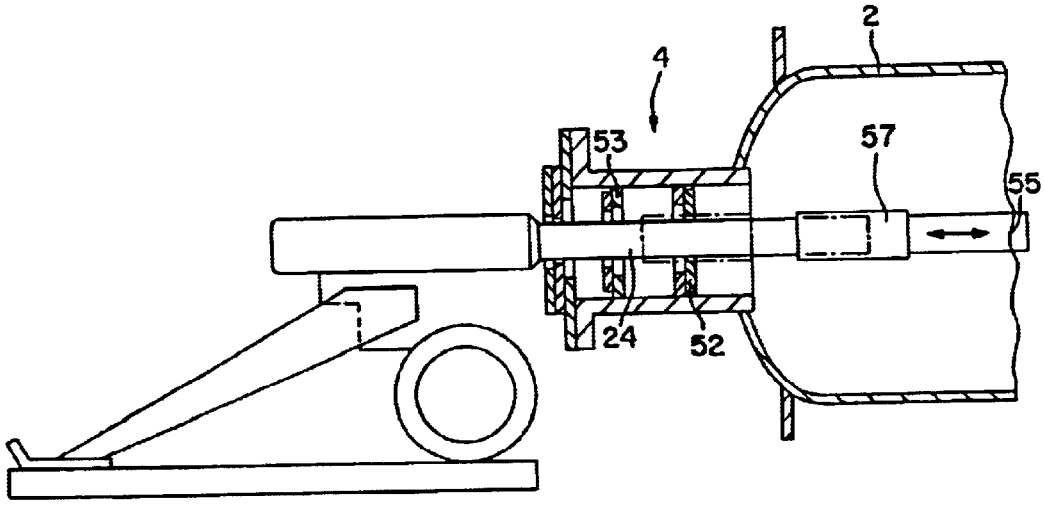
FIG. 6 PRIOR ART
FIG. 6 is a fragmentary side elevational view of a gun, having a longer tube than the gun shown in FIG. 5 and the gun muffler, partly in section.

FIGS. 5 and 6 show the transition section 4 in detailed cross section. FIG. 5 shows a gun having a shorter gun tube than the gun tube of FIG. 6. In either case, the transition section 4 includes radially inward protruding flanges 52, 53 which serve as seals for engaging gun tube 24 for preventing residual combustion gases caused by the firing of the gun from escaping back through the transition section 4. FIG. 6 also shows a supplemental tube 55 having an enlarged portion 57 which fits over the gun tube 24. The projectile passes through the gun tube 24 and through the supplemental tube 55 through the entire muffler 50.

Figure 7:
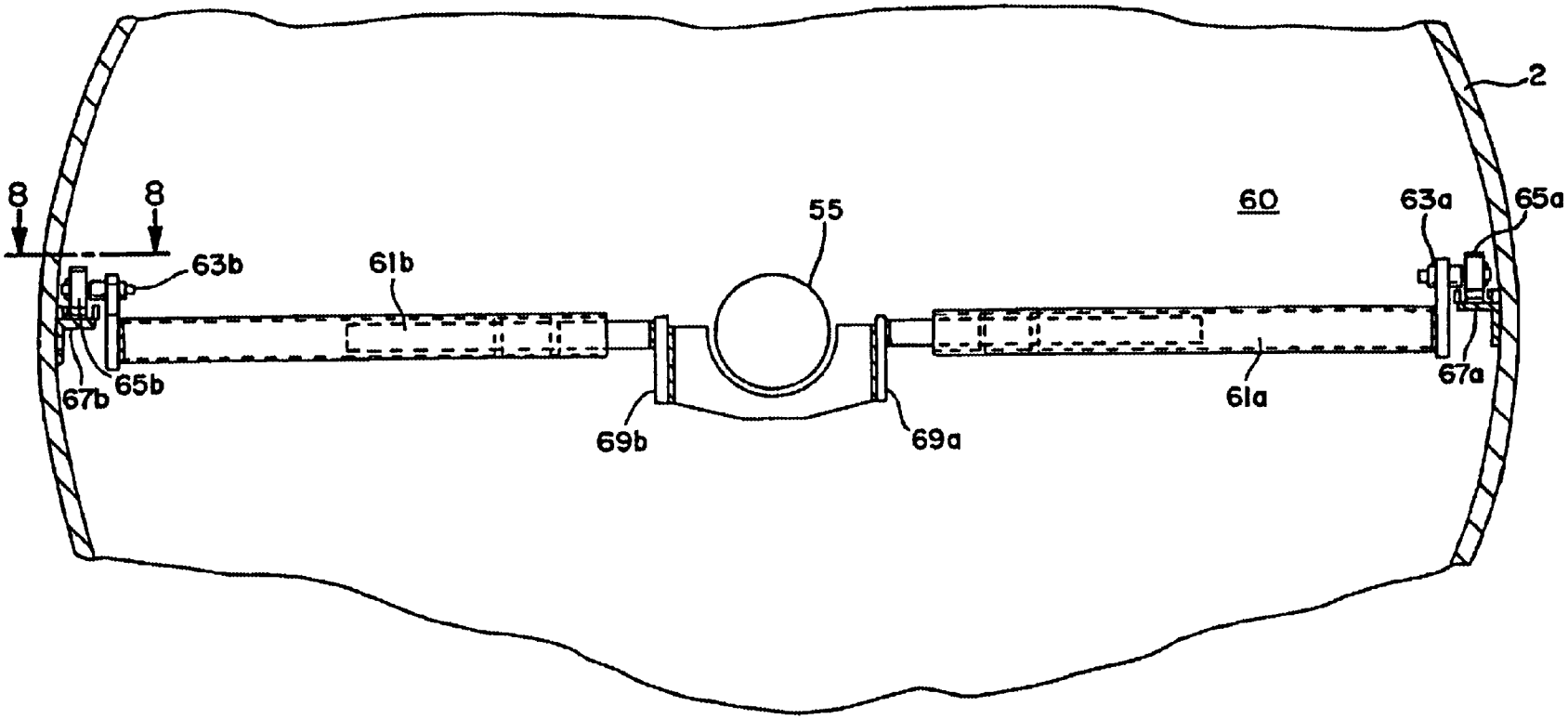
FIG. 7 PRIOR ART
FIG. 7 is an enlarged fragmentary transverse sectional view, showing a tube transporter used with the present invention.
Figure 8:
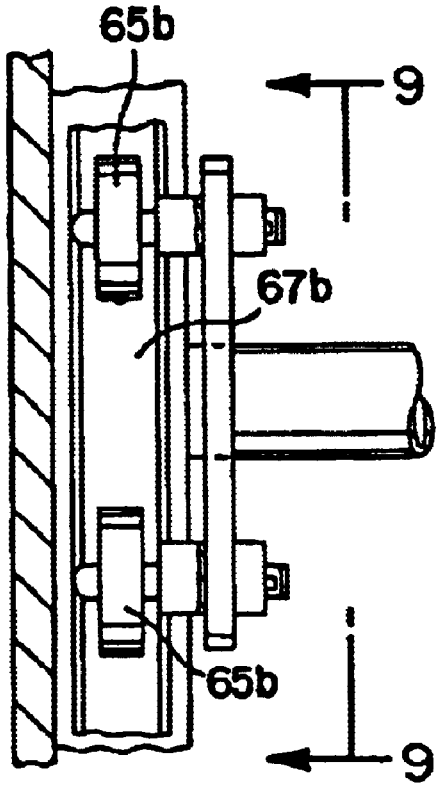
FIG. 8 PRIOR ART
FIG. 8 is an enlarged fragmentary horizontal sectional view of a portion of the tube transporter of FIG. 7, taken along the line 8—8 of FIG. 7.
Figure 9:
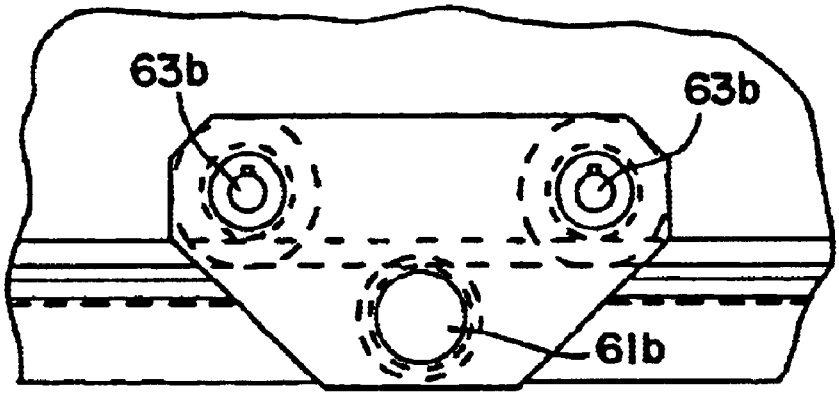
FIG. 9 PRIOR ART
FIG. 9 is a fragmentary vertical sectional view of the tube transporter of FIG. 7, taken along the line 9—9 of FIG. 8.

FIG. 7 shows a cross section of the main pressure vessel 2 at a point through which the supplemental tube 55 extends. A supplemental tube transporter assembly 60 is shown. The supplemental tube transporter assembly 60 includes a first extendable arm 61*a* and a second extendable arm 61*b*. At one end of each extendable arm is a coupling 63*a,b* respectively, for coupling each extendable arm to a respective pair of wheels 65*a,b*. As shown in FIG. 8, the wheels 65*a,b* engage and move along respective tracks 67*a,b*, which extend parallel to one another and longitudinally along the inner surface of the main pressure vessel 2. Such a transporter tube assembly 60 could also be disposed in the extension pressure chamber 33. The supplemental tube transporter assembly 60 also includes flanges 69*a,b* respectively coupled to the ends of the extendable arms 61*a,b* opposite the ends attached to the wheels. Flanges 69*a,b* are selectively attached to the supplemental tube 55.

In operation,. the transporter tube assembly 60 is used to transport the supplemental tube 55 from the exit end of the extension pressure chamber 3 to a point so that it engages with a gun tube 24. This is done by first rolling the wheels 65*a,b* along tracks 67*a,b* towards the exit end of the pressure vessel. Then, the supplemental tube 55 is pushed through the exit hole of the extension pressure vessel 3 and into the extension pressure chamber 33. The extendable arms 61*a,b* are extended so that flanges 69*a,b* are in engagement with the supplemental tube 55. Then, the entire assembly 60 is moved towards the entry end of the pressure vessel.

After placing the supplemental tube 55 in engagement with the gun tube and securing the transition section 4 over the top of the gun tube, the gun is ready for firing. Initially, the valve 18 is closed when the gun is fired. As a consequence of firing, combustion gases fill the main pressure chamber 32 and the extension pressure chamber 33. The pressure waves caused by the filing of the gun are attenuated by the orifice plate 7 and the baffle and orifice plate assemblies disposed in series in the extension pressure chamber 33. Thus, both pressure vessels 2, 3 serve to contain residual combustion gases and attenuate the pressure waves.

Immediately after firing and attenuation of the pressure waves, the valve 18 is opened thereby permitting the exhaust blower 17 to remove the residual combustion gases from the main pressure chamber 32. This process is repeated rapidly. As mentioned above, the main pressure vessel 2 and the extension pressure vessel 3 are preferably covered with sand, which is contained by the left-end plate 40 and the right-end plate 41.

Figure 10:
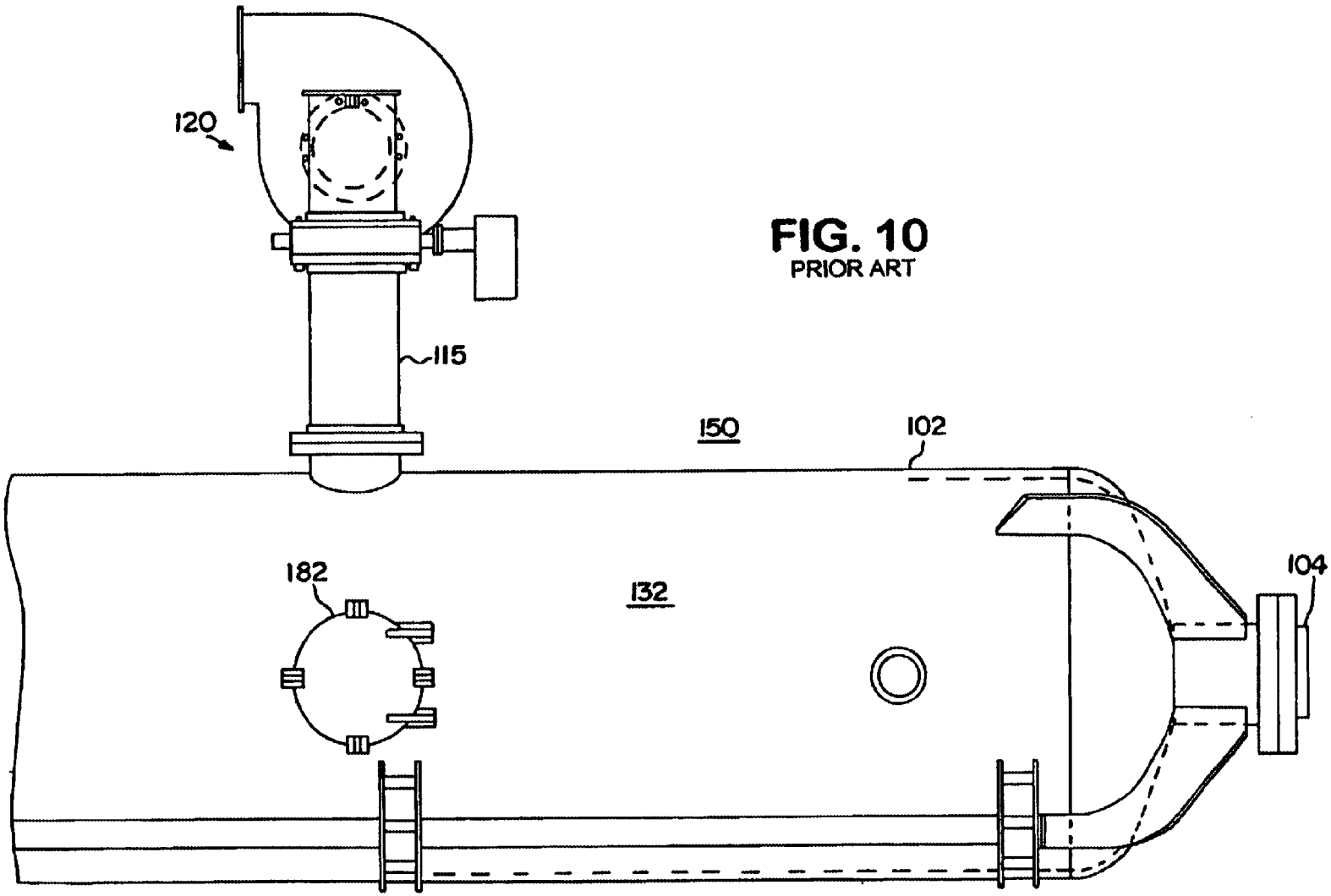
FIG. 10 PRIOR ART
FIG. 10 is a fragmentary longitudinal side elevational view of the right portion of a second embodiment of a gun muffler used with the present invention.
Figure 10A:
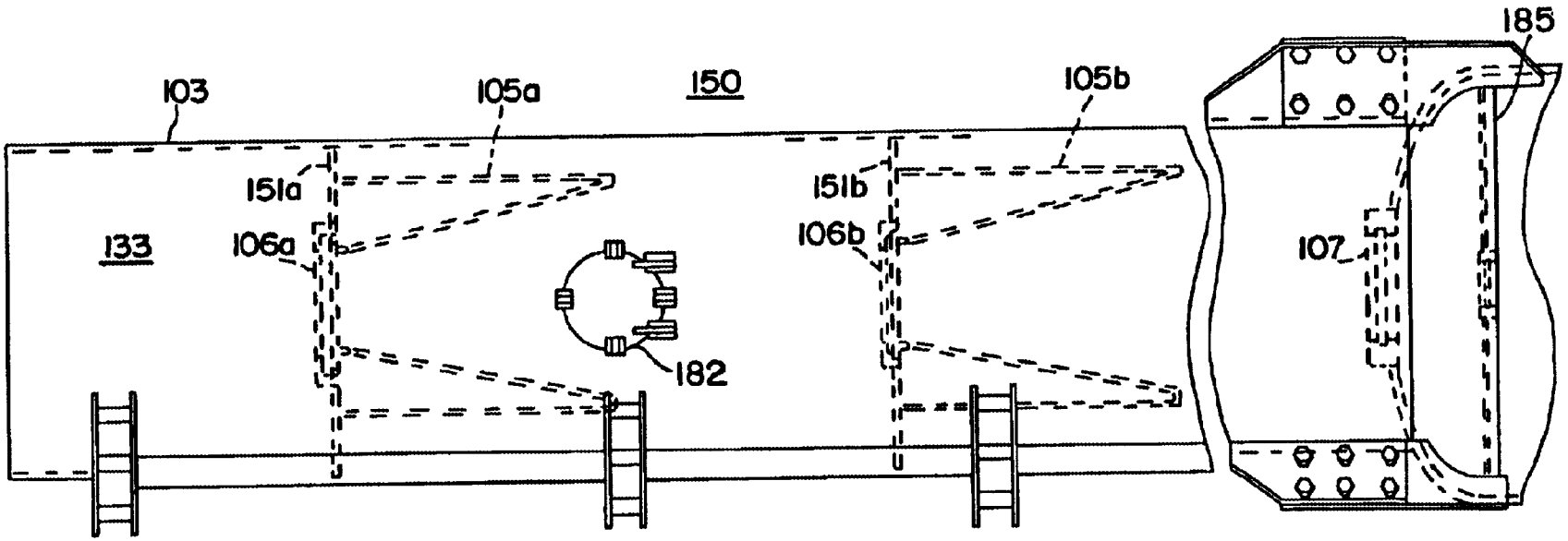
FIG. 10A PRIOR ART
FIG. 10A is a fragmentary longitudinal side elevational view of the left portion of the gun muffler shown in FIG. 10.

The gun muffler 150 in accordance with another embodiment of the present invention is shown in FIGS. 10 and 10A. In the same manner as the gun muffler 50, the gun muffler 150 includes a transition section 104 and at least one pressure vessel. Preferably, the gun muffler 150 includes a main pressure vessel 102 defining a main pressure chamber 132 and an extension pressure vessel 103, disposed in series with and connected to main pressure vessel 102 and defining an extension pressure chamber 133. The volume and shape of the pressure vessels 102, 103 may be similar to those of the pressure vessels 2, 3 of the gun muffler 50. Also similar to the gun muffler 50, the gun muffler 150 includes a vent stack 115 and an exhaust blower and valve assembly 120 connected to vent stack 115. As in the gun muffler 50, the valve of an exhaust blower and valve assembly 120, which preferably is a butterfly valve, closes during firings of the gun for preventing pressure waves caused by firing from escaping directly to the atmosphere during firing and opens between firings for permitting said exhaust blower to remove residual combustion gases from said pressure chamber. The gun muffler 150 may also incorporate some other features from the gun muffler 50. For example, the gun muffler 150 may include a tube transporter system shown in FIGS. 7–9.

The gun muffler 150 includes at least one orifice plate, which is adjustable relative to the pressure vessels and disposed in a pressure chamber, for attenuating pressure waves. More specifically, FIG. 10A shows three adjustable orifice plates. A first orifice plate 106*a* is disposed in the extension chamber 133 and has a first orifice, through which the projectile passes and which is adjustable relative to the longitudinal axis of the extension pressure vessel 103. A second orifice plate 106*b* is disposed in series with the first orifice plate 106*a* in the extension pressure chamber 133 and has a second orifice, through which the projectile passes and which is adjustable relative to the longitudinal axis of the extension pressure vessel 103. The first orifice plate 106*a* and second orifice plate 106*b* are identical. A third orifice plate 107 is disposed within the extension pressure chamber 133 near the connection of the main pressure vessel 102 to the extension pressure vessel 103 and has a third orifice, through which the projectile passes and which is adjustable relative to the longitudinal axis of the extension pressure vessel 103.

Figure 11:
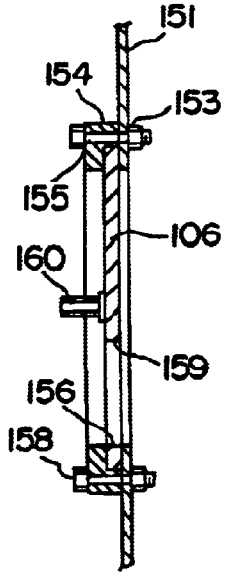
FIG. 11 PRIOR ART
FIG. 11 is an enlarged fragmentary sectional view of the first and second orifice plates shown in FIG. 10A.

The orifice plates may be made adjustable in any known manner. FIG. 11 shows one way to make the first and second orifice plates 106*a*, 106*b* adjustable. FIG. 11 shows either orifice plate and the surrounding elements and is discussed below with direct reference to the first orifice plate 106a and parenthetical reference to the second orifice plate 106*b*. A first (or second) mounting plate 151 is connected (i.e., welded or bolted) to the extension pressure vessel 103 and has a first (or third) bolt hole 153. As shown in FIG. 10A, energy-absorbing baffles 105*a*, 105*b* may be respectively mounted to the first and second mounting plates 151*a*, 151*b*. A first (or second) retaining ring 154 has a second (or fourth) bolt hole 155 aligned with first (or third) bolt hole 153 and has a first (or second) recess 156 confined by the first (or second) mounting plate 151. The first (or second) orifice plate 106 is secured to the first (or second) mounting plate 151 and the first (or second) retaining ring 154 at the first (or second) recess 156.

A first (or second) bolt 158 extends through the first bolt hole 153 and the second bolt hole 155 (or through third and fourth bolt holes). By loosening the first (or third) bolt 158, the first (or second) orifice plate 106 may be adjusted to alter the location of a first (or second) orifice 159 relative to the longitudinal axis of the extension pressure vessel 103. For example, the first (or second) orifice plate 106 may be rotated by rotating a first (or second) handle 160, which is connected to the first (or second) orifice plate 106. More than one handle may be used to rotate the orifice plate 106 for ease of rotation. Upon reaching a desired position of the first (or second) orifice 106, the first (or third) bolt 158 is tightened to prevent further rotation of the first (or second) orifice plate 106.

Figure 12:
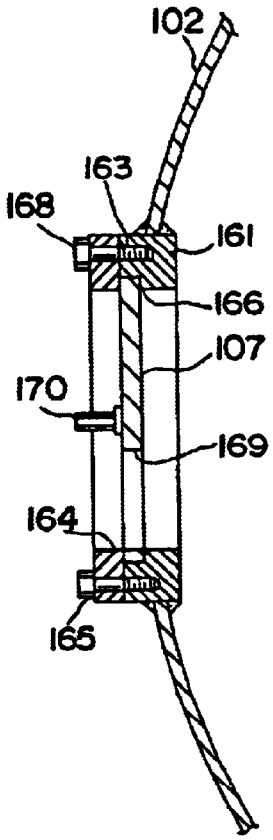
FIG. 12 PRIOR ART
FIG. 12 is an enlarged fragmentary sectional view of the third orifice plate shown in FIG. 10A.

Similarly, as shown in FIG. 12, a third mounting plate 161 is connected (i.e., welded or bolted) to the main pressure vessel 102 and has a third:recess 166 and a fifth bolt hole 163. A third retaining ring 164 has a sixth bolt hole 165 aligned with the fifth bolt hole 163 and. confines the third recess 166. The third orifice plate 107 is secured to the third mounting plate 161 and the third retaining ring 164 at the third recess 166. A third bolt 168 extends through the fifth bolt hole 163.and the sixth bolt hole 165. By loosening the third bolt 168, the third orifice plate 107 may be adjusted to alter the location of the third orifice 169 relative to the longitudinal axis of the extension pressure vessel 103. For example, the third orifice plate 107 may be rotated by rotating a third handle 170, which is connected to the third orifice plate 107. More than one handle may be used to rotate the orifice plate 107 for ease of rotation. Upon reaching a desired position of a third orifice, the third bolt 168 is tightened to prevent further rotation of the third orifice plate 107.

Figure 13:
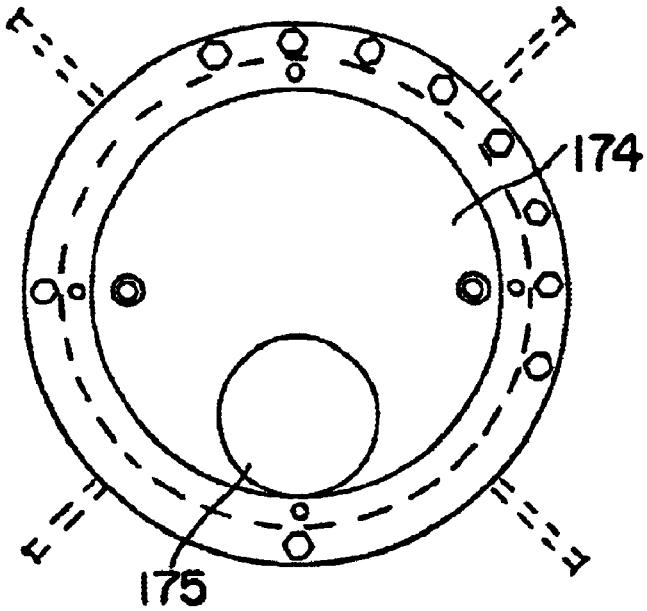
FIG. 13 PRIOR ART
FIG. 13 is a plan view of an orifice plate having a circular, off-centered orifice.
Figure 14:
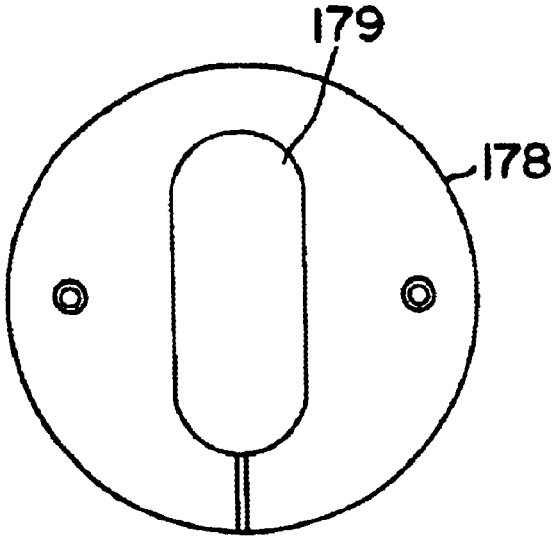
FIG. 14 PRIOR ART
FIG. 14 is a plan view of an orifice plate having an elliptical orifice.

A first type of orifice plate is shown in FIG. 13. The orifice plate 174 as shown has an orifice 175 which is circular and disposed off-centered relative to the orifice plate 174. Also shown in FIG. 13 is a retainer ring. An alternative type of orifice plate is shown in FIG. 14. There, the orifice plate 178 as shown has an orifice 179 which is elliptical. The orifice plates are adjustable in order to accommodate varying trajectories. Also, the orifice plate 178 having an elliptical orifice 179 is particularly useful if a projectile undergoes a drop in trajectory as it travels along the gun muffler 150.

As shown in FIG. 10A, a plurality of side ports 182 may be disposed along the sides of the pressure vessel. Side ports 182 may be used for a variety of purposes. For example, the side ports 182 may be used for access, viewing, photography and radar. The side ports 182 may be made of a transparent material if used for viewing. According to this embodiment of the invention, the gun muffler 150 is not covered with sand in operation.

As shown in FIG. 10A, a sabot catcher 185 is disposed within one of the pressure vessels or entrapping particulates caused by the firing of a gun. The catcher 185 may be made of any suitable material for permitting gas to pass through but for preventing the passage of particulates. For example, it is known to use cables woven together as a sabot catcher. The catcher 185 is mounted to the main pressure vessel 102, such as by being welded or bolted thereto. The catcher 185 is preferably disposed in the main pressure chamber 132 near the connection of the main pressure vessel 102 to the extension pressure vessel 103.

When the gun muffler 350 comprises some or most of the features from the gun muffler 150, it is preferred that the gun muffler 350 does not also comprise the catcher 185.

Figure 24A:
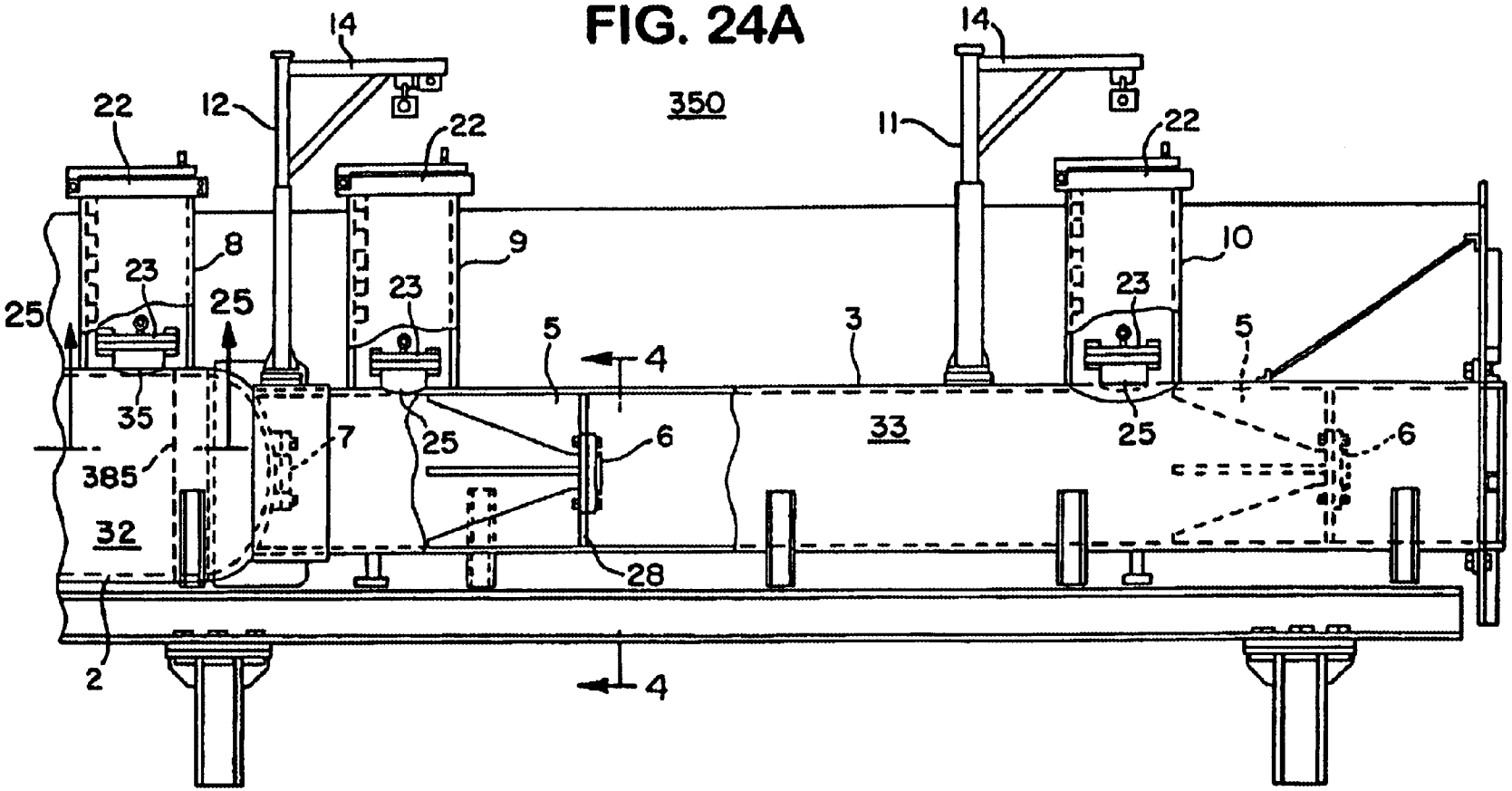
FIG. 24A is a fragmentary longitudinal side elevational view of the right portion of the gun muffler shown in FIG. 24.

As shown in FIGS. 24A and 25 and in accordance with an embodiment of the present invention, the sabot catcher 385 comprises a plurality of columns 386 that are disposed within the pressure vessels 2, 3 for entrapping particulates, such as soft metallic or plastic fragments (also referred to as the sabot) that separates from the projectile after the projectile is fired from the gun, and for permitting the projectile to pass through. The entrapment of the sabot by the columns 386 minimizes, preferably substantially minimizes or eliminates, potential damage that would otherwise be caused to the vessels 2, 3 by the sabot making contact with the vessels 2, 3. Thus, the longevity of the vessels 2, 3 can be extended.

The columns 386 may be positioned in various arrangements so as to be effective in minimizing the potential damage that can be caused to the vessels 2, 3, while also permitting the projectile to pass through. Each column 386 preferably extends generally vertically, relative to a central axis of the main pressure vessel 2. The columns 386 preferably define two sets of columns 386 formed on both sides of the central axis of the main pressure vessel 2, and an opening 388 between the two sets of columns 386 for allowing the projectile to pass through. As best shown in FIG. 25, each set of columns 386 is formed on a corresponding side of the central axis of the main pressure vessel 2 and the columns 386 are generally parallel to one another. Each column 386 is preferably staggered relative to an adjacent column 386 with respect to the direction along the central axis of the main pressure vessel 2 so as to provide each set of columns 386 with sufficient strength for absorbing and withstanding the physical contacts that will be made by the sabot. Other arrangements may also provide each set of columns 386 with sufficient strength.

The columns 386 are preferably adapted for being removably attached in the main pressure chamber 32 near the connection of the main pressure vessel 2 to the extension pressure vessel 3. The columns 386 can be mounted to the main pressure vessel 2, such as by being welded or bolted thereto or by any other method or sealing device known in the art. For example, if the columns 386 are mounted to the main pressure vessel 2 by welding, the columns 386 that are damaged by the contacts with the sabot can simply and efficiently be removed by grinding off the welding and then removing the damaged columns 386 from the main pressure vessel 2. As replacements, new or undamaged columns 386 can then be removably attached to the main pressure vessel 2 at preferably about the same positions.

Preferably, each column 386 is comprised of steel, is substantially cylindrical, is filled with a particulate material 390, preferably concrete, and has a diameter of about 1 foot.

Several or all of the columns 386 can alternatively be attached or removably attached at other locations in the vessels 2, 3. Preferably, little or no space exists between the columns 386 in the direction of travel of the sabot or particulates to maximize blockage of the sabot or particulates. Also, each column 386 may extend from other positions or angles relative to the central axis of the main pressure vessel 2, may be comprised of other materials, such as other metals or hard plastic, may be of other shapes, and may be filled with other particulate materials, such as sand.

Figure 26:
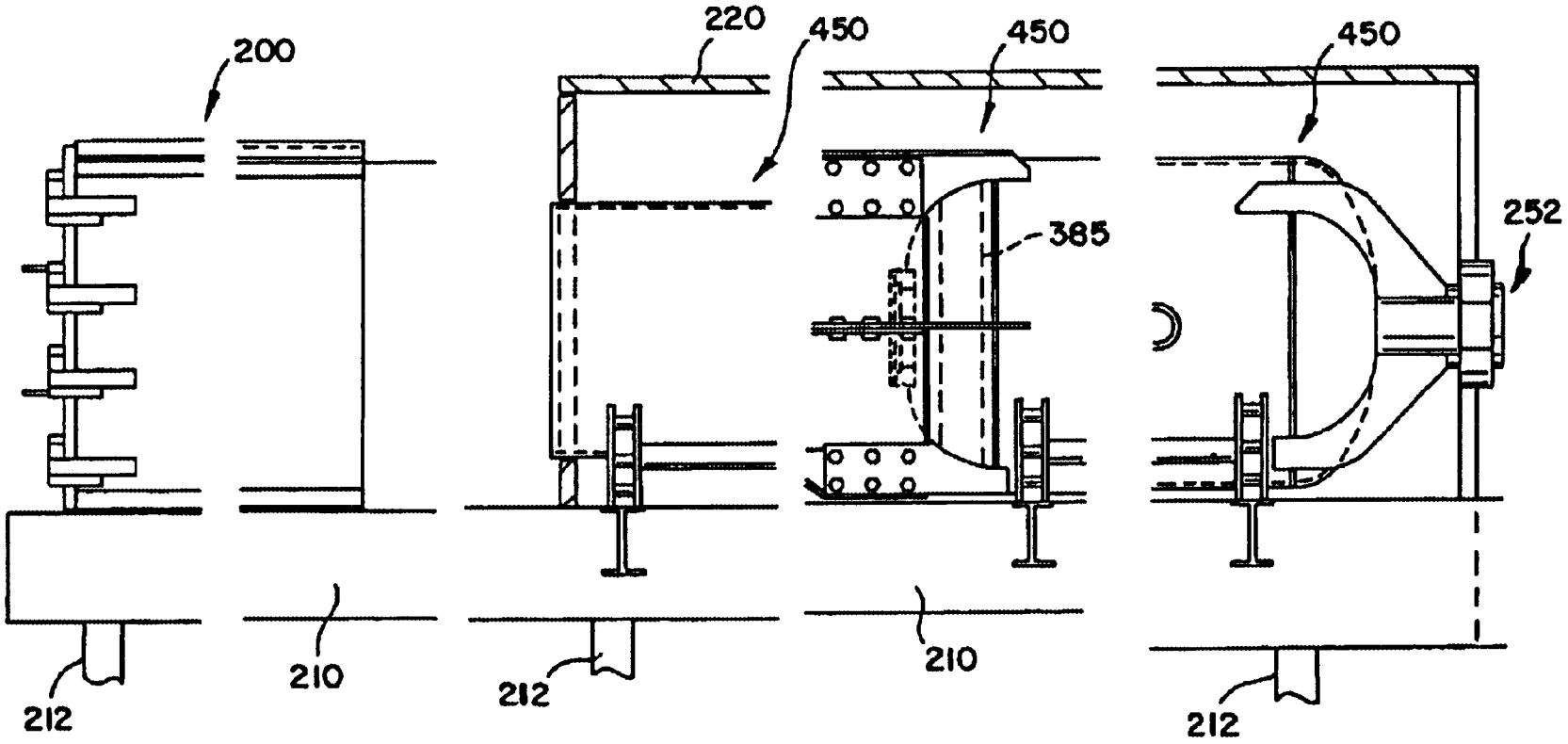
FIG. 26 is a longitudinal side elevational view of another embodiment of a noise abatement system of the present invention.

Referring to FIG. 26, the noise abatement system of the present invention includes a concrete slab 210 and a gun muffler 450 mounted to the concrete slab 210. The gun muffler 450 serves to attenuate pressure waves caused by a firing of a projectile of a gun. In addition to comprising the sabot catcher 385 as that described above, in connection with FIGS. 24–25, the gun muffler 450 can comprise some or all of the features from a gun muffler 50 discussed below in connection with FIGS. 1–9, a gun muffler 150 discussed below in connection with FIGS. 10–14, a gun muffler 250 discussed below in connection with FIGS. 15–23, or a gun muffler 350 discussed below in connection with FIGS. 24–25. Alternatively, the gun muffler 450 can comprise a combination of features from the gun mufflers 50, 150, 250, 350.

The gun muffler 250 has a first end 252 which is adapted to be coupled to the tube of a gun, as discussed in more detail below. The gun muffler 250 is mounted to the concrete slab 210 in any known manner. For example, the gun muffler 250 may be mounted to the concrete slab 210 by using bolts in a similar manner as discussed below in connection with the mounting of the projectile stop 200 with the concrete slab 210.

The concrete slab 210 may be prepared from any conventional poured concrete.

Figure 15:
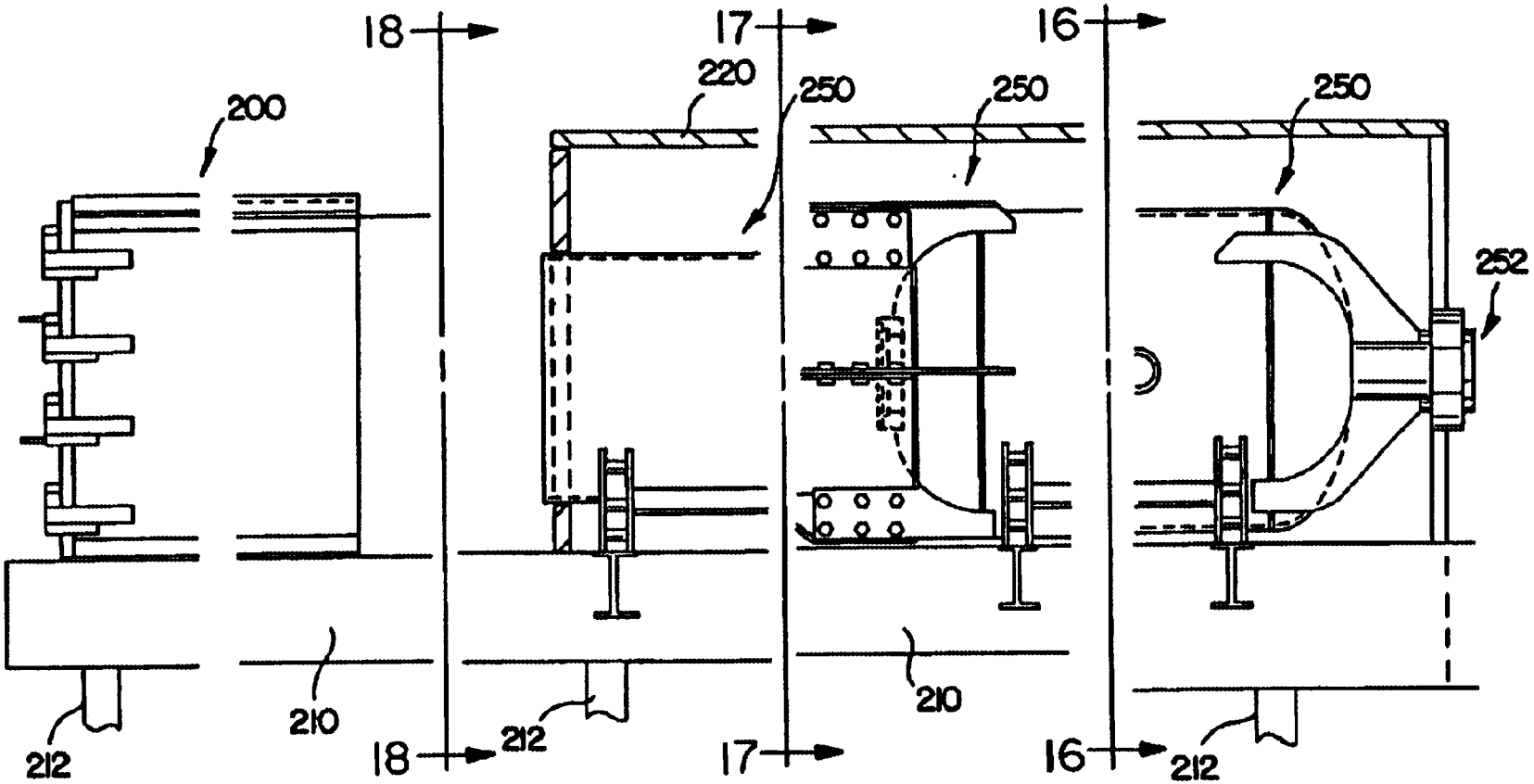
FIG. 15 PRIOR ART
FIG. 15 is a longitudinal side elevational view of the noise abatement system of the present invention.

The concrete slab 210 should have a thickness sufficient to support the gun muffler 250 25 and the projectile stop 200, including when the projectile stop 200 is loaded with a particulate material such as sand. Preferably, the concrete slab 210 may have a thickness of 2 to 6 feet, and more preferably 4 feet. As shown in FIG. 15, the concrete slab 210 has a greater thickness near end 252 of the gun muffler 250 than the remainder of the concrete slab 210. Not shown in FIG. 15 is the gradual decrease in 30 thickness of the concrete slab 210 occurring between the first and second shown portions of the gun muffler 250 near the end 252. As shown in FIG. 15, the concrete slab 210 is preferably horizontal. Preferably, the concrete slab 210 is anchored to the ground or earth. For example, a plurality of support piles 212 may extend downward from the concrete slab 210 to bedrock.

Figure 16:
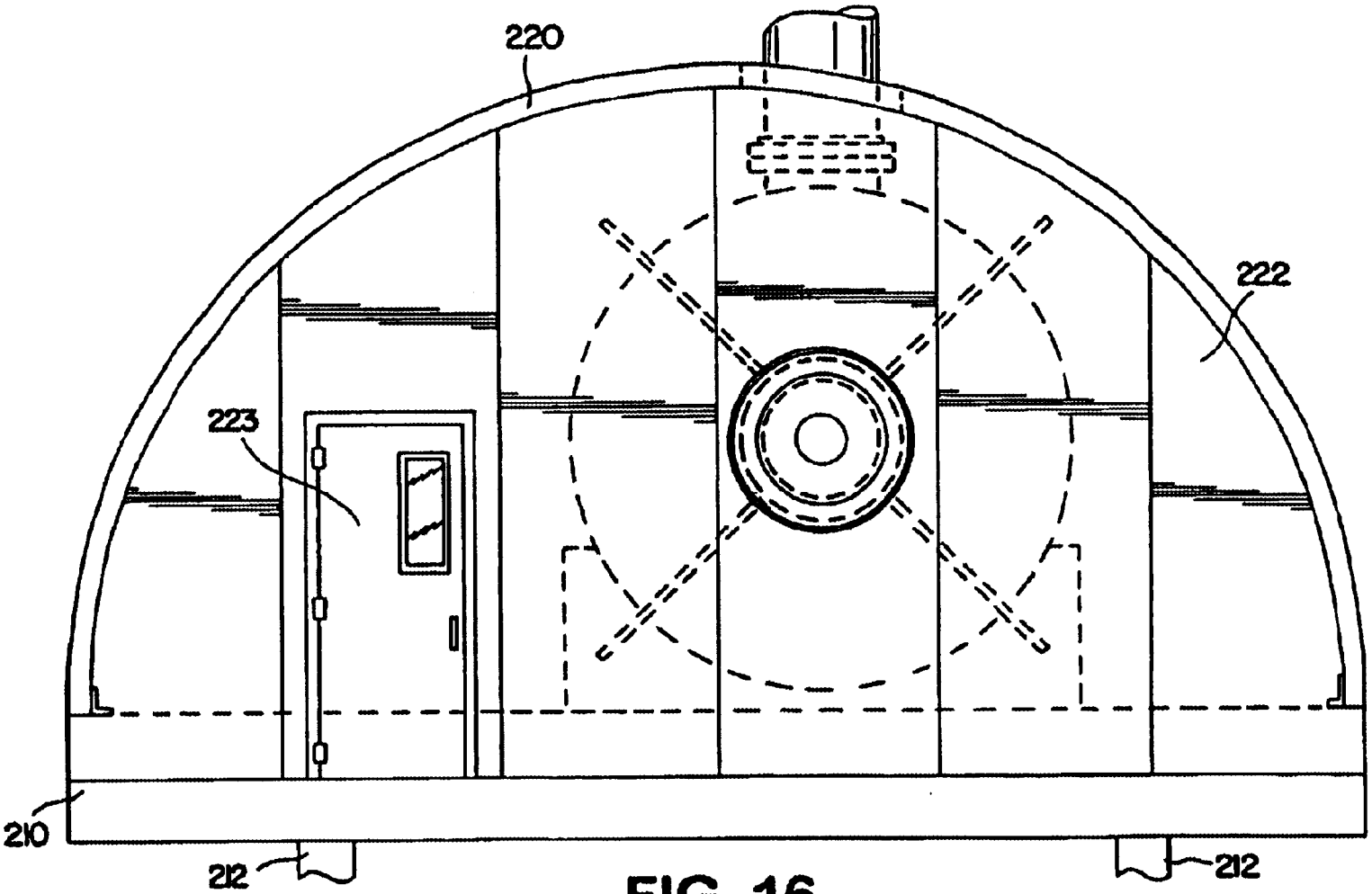
FIG. 16 PRIOR ART
FIG. 16 is an enlarged transverse end view, showing an end of the enclosure of a gun muffler used with the present invention, taken along the line 16—16 of FIG. 15.
Figure 17:
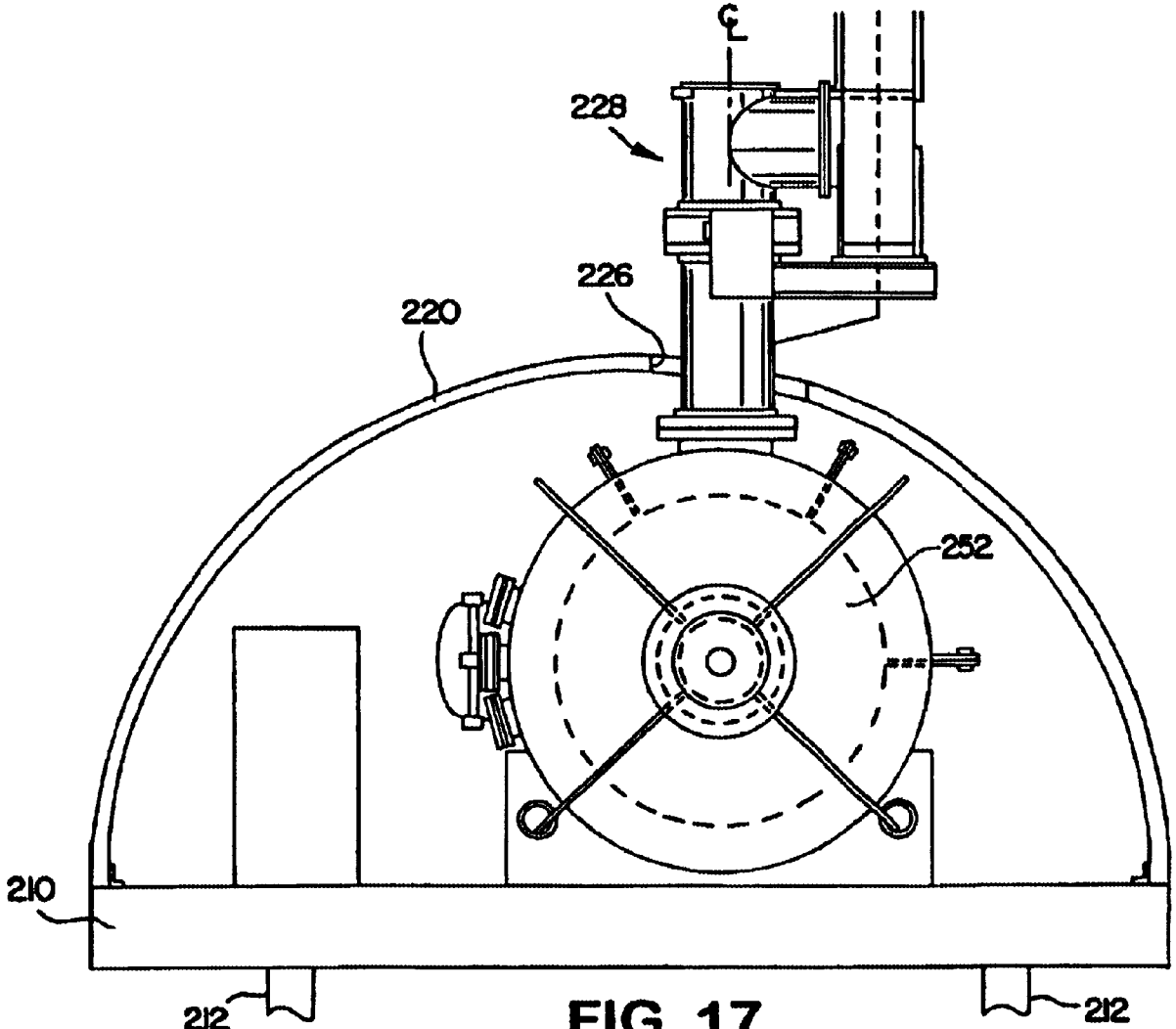
FIG. 17 PRIOR ART
FIG. 17 is enlarged transverse view (with the end wall removed), showing an end of a gun muffler used with the present invention, taken along the line 17—17 of FIG. 15.
Figure 18:
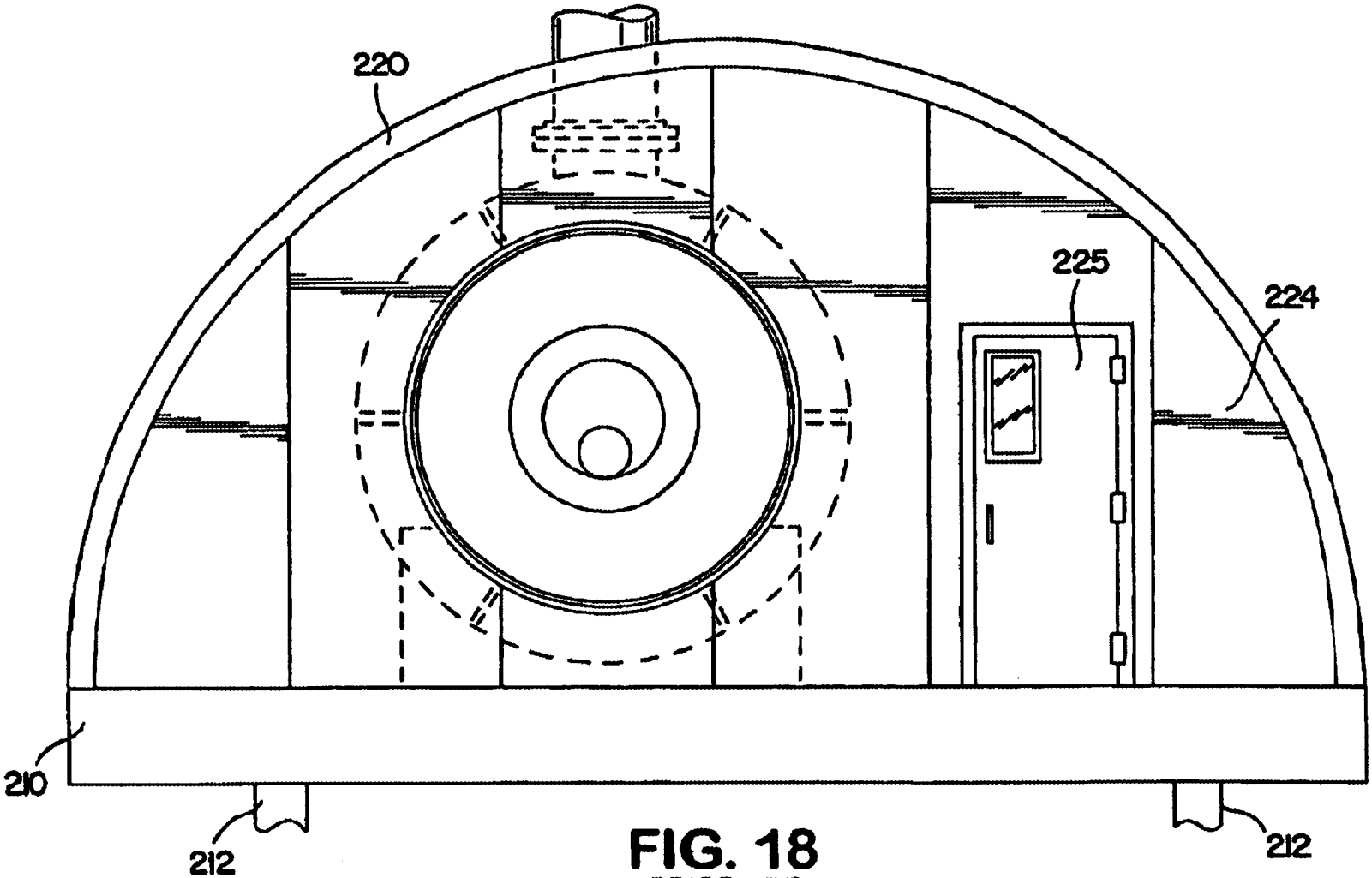
FIG. 18 PRIOR ART
FIG. 18 is an enlarged transverse end view, showing the other end of the enclosure of a gun muffler used with the present invention, taken along the line 18—18 of FIG. 15.

Shown in FIG. 15 and more clearly in FIGS. 16–18 is a housing or arch (e.g., a "Quonset" arch) which serves to protect the gun muffler and the related instrumentation, such as the valves, hatches, and electrical instrumentation, from the environment. Arch 220 may be any suitable material, such as light weight corrugated steel, sheet metal, or plastic. As shown in FIGS. 16 and 18, the arch 220 is disposed over the gun muffler 250 and has end walls 222, 224 at each end with, respectively, doors 223, 225 for personnel to enter the interior of the arch and open 254 in end wall 224, as shown in FIG. 17 also shows the end 252 of the gun muffler 250. An opening 226 exists in the arch 220 for permitting the valve and blower assembly 228 to extend through and to the exterior of the arch 220.

Figure 20:
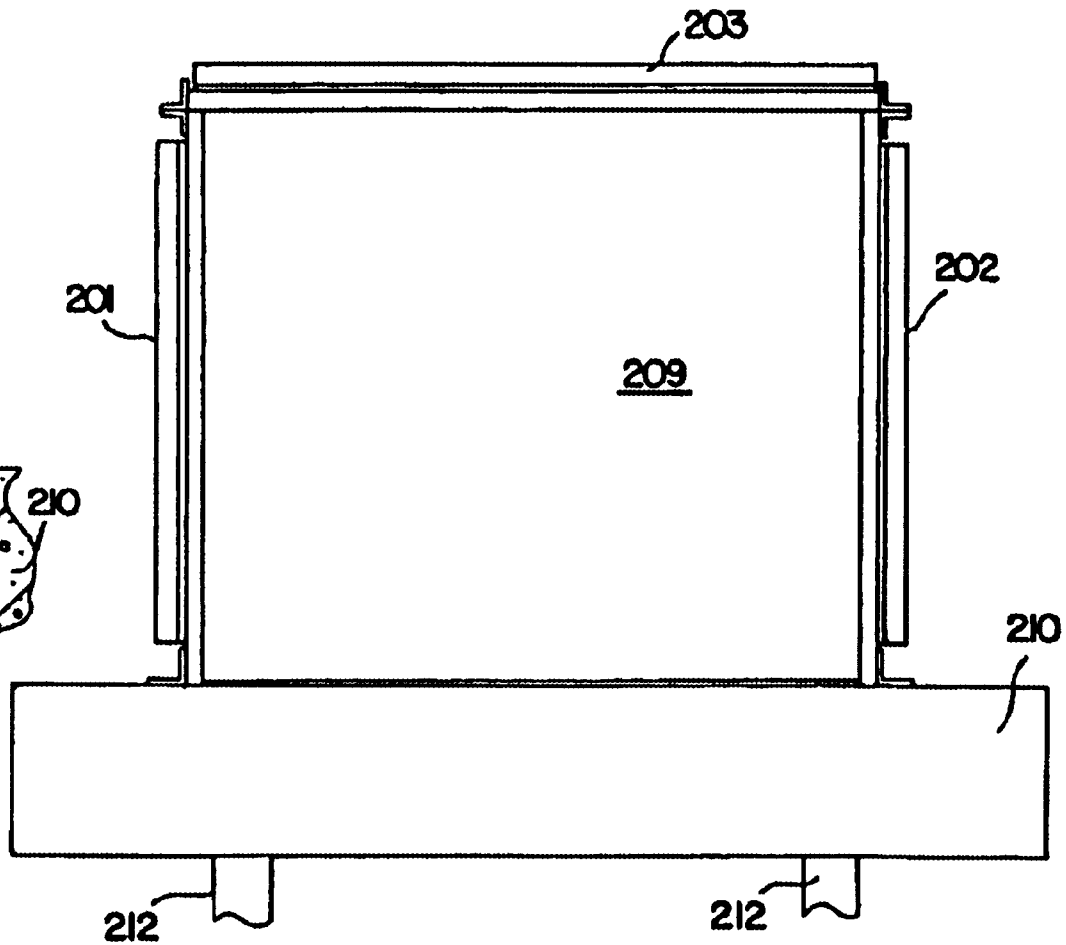
FIG. 20 is an enlarged transverse end view, showing the end of the projectile stop closest to the gun muffler used with the present invention, taken along the line 20—20 of FIG. 15.
Figure 19:
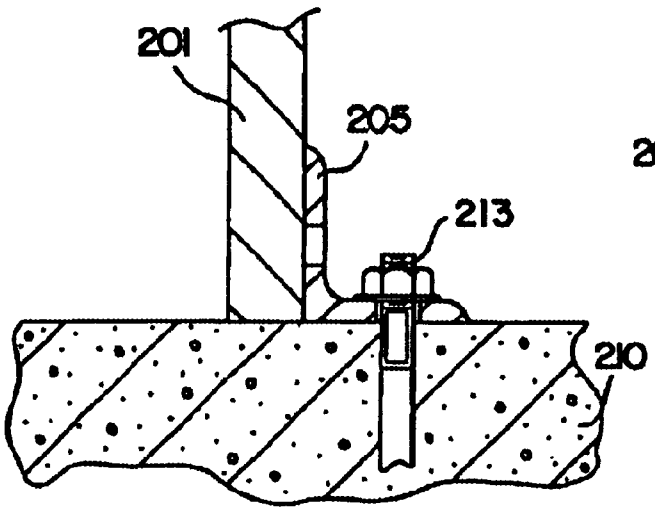
FIG. 19 PRIOR ART
FIG. 19 is an enlarged transverse sectional view, showing the connection between the projectile stop and the concrete slab, taken along the line 19—19 of FIG. 22.

FIGS. 20–23 show the ends, sides, and top of the projectile stop 200. As shown, the projectile stop 200 is substantially rectangular in shape. Each side, wall, and top of the projectile stop 200 can be made of steel, preferably about 4 inches thick. As shown in FIG. 20, the projectile stop 200 is comprised of a first side wall 201, a second side wall 202 (identical to the first side wall 201), and a top plate 203. In use, the side walls 201, 202 may be 10 feet high, and the top plate 203 may be 12 feet wide. FIG. 19 shows how the projectile stop 200 is mounted to the concrete slab 210. More specifically, an "L-connector",205 is mounted to the base of the side walls 201, 202 and; then is subsequently affixed to the concrete slab 210 by a bolt 213. The L connector 205 may be connected to the side wall 201 by a similar bolt (not shown).

Figure 21:
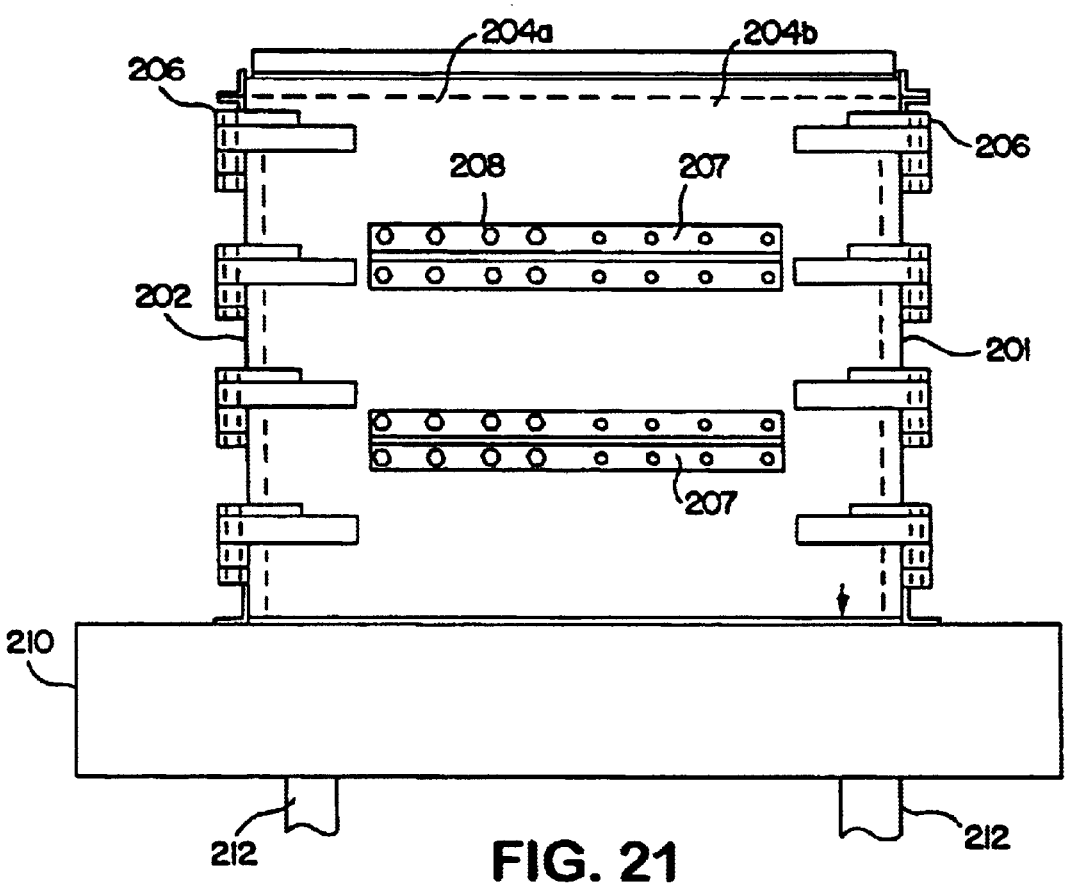
FIG. 21 PRIOR ART
FIG. 21 is an enlarged transverse end view, showing the other end of the projectile stop, taken along the line 21—21 of FIG. 15.

FIG. 21 shows doors 204*a*, 204*b* which are respectively mounted by conventional heavy duty hinges 206 to the side walls 202, 201, respectively. Accordingly, the doors 204*a*, 204*b* can swing open and closed as needed. To lock the doors in a closed position, latches 207 are aligned with recesses in the doors (not shown) and bolts are subsequently screwed through recesses 208 in the latches and into the recesses of the doors 204*a*, 204*b* to keep the doors closed.

Figure 22:
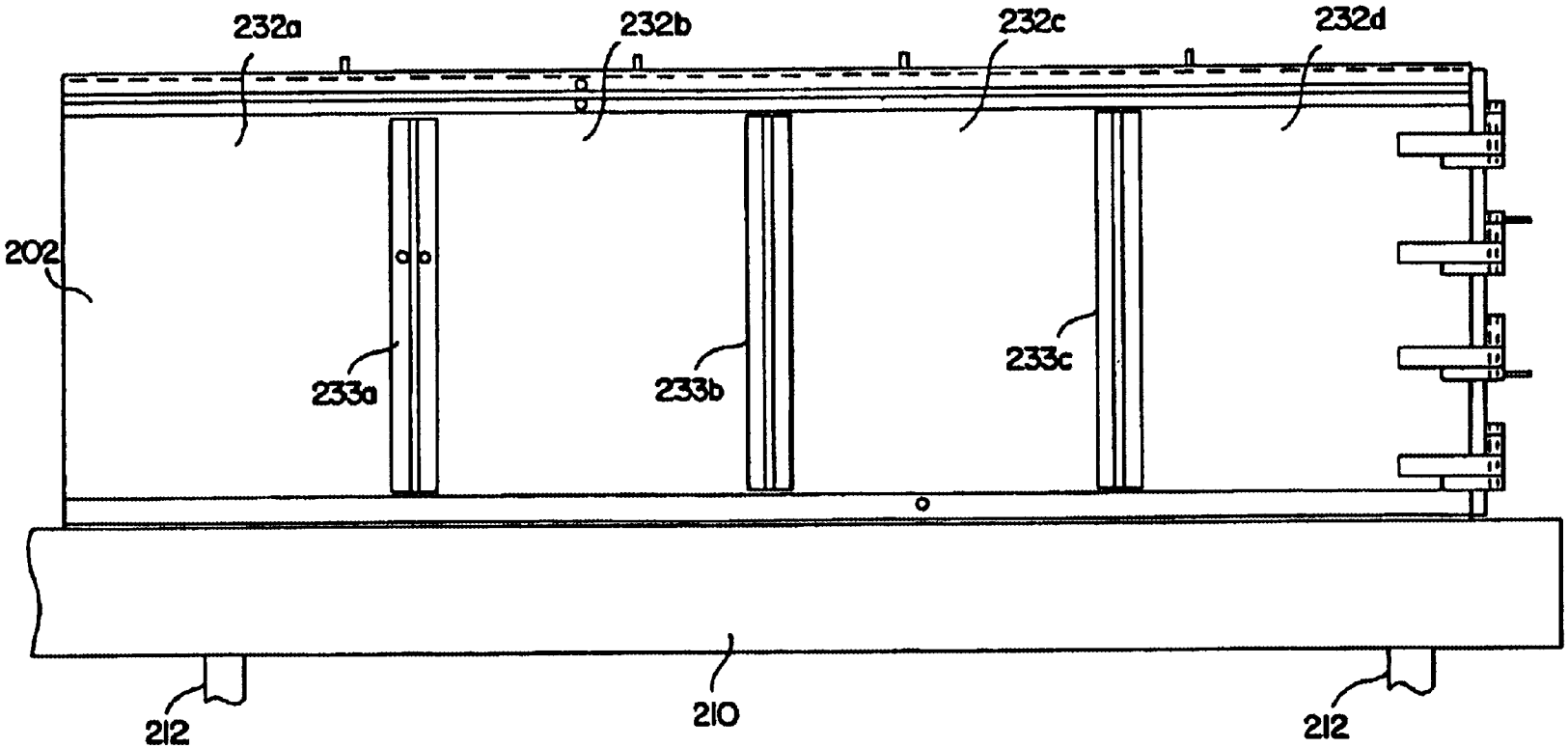
FIG. 22 PRIOR ART
FIG. 22 i side elevational view of the projectile stop shown in FIG. 15.

FIG. 22 shows the side wall 202 mounted on the concrete slab 210. As shown, the side wall 202 can actually be comprised of a plurality of panels 232*a*, 232*b*, 232*c*, 232*d*. The panels 232*a*–232*d* can be connected to one another by connectors 233*a*–233*c*.

FIG. 23 shows the top plate 203. In the same manner as the side walls 201 or 202, the top plate 203 can actually be comprised of a plurality of top panels 234*a*–234*e*, which can be connected by connectors 235*a*–235*d*. The top plate 203 is coupled to the side walls 201, 202 in any known manner, such as by being bolted thereto, and may be removable by a crane, for repairs.

As shown in FIG. 15, the projectile stop 200 is longitudinally spaced from the gun muffler 250. In operation, when it is desired to aim at a target beyond the projectile stop 200, the doors 204*a*, 204*b* are opened and interior space 209 is emptied by a front end loader through the open end of the projectile stop 200. When it is desired to stop the projectile, the doors 204*a*, 204*b* are shut and locked into place by use of latches 207. Subsequently, the interior space 209 is filled with a particulate material, such as sand, through the open end of the projectile stop 200. Then the gun is fired and the projectile subsequently retrieved upon emptying of the interior space 209.

It is desirable to build the projectile stop of a sufficient size such that over 1 million foot-pounds of energy can be absorbed. In one embodiment, which is 10 feet high, 12 feet deep, and 32 feet long, such a projectile stop can absorb over 40 million foot-pounds of energy when filled with sand. Thus, such a system can be used to stop 6.1 inch diameter projectiles.

Although illustrated and described herein with reference to certain specific embodiments, the claims of the present invention are nevertheless not intended to be limited to the details illustrated and described. Rather, the claims are meant to cover various common modifications without departing from the spirit of the invention.

What is claimed is:

1. A gun muffler for a large caliber gun having a gun tube, said gun muffler comprising:

a transition section fitted around the gun tube and engaging. the gun tube for preventing the escape of residual combustion gases caused by a firing of a projectile by the gun;

a pressure vessel having a first end attached to said transition section and being adapted for containing residual combustion gases and attenuating pressure waves; and a catcher disposed within said pressure vessel for entrapping particulates and for permitting the projectile to pass, said catcher comprising a plurality of columns adapted for being removably attached within said pressure vessel;

wherein said columns are in a generally parallel arrangement and at least two of said columns are staggered relative to one another with respect to the direction along a central axis of said pressure vessel.

2. The gun muffler according to claim 1, further comprising at least one orifice plate, wherein:

said pressure vessel comprises a main pressure vessel and an extension pressure vessel,. said main pressure vessel has a first end attached to said transition section and defines a main pressure chamber of about 4,000 cubic feet for containing residual combustion gases and attenuating pressure waves, said extension pressure vessel is disposed in series with and connected to said main pressure vessel and defines an extension pressure chamber of about 1,000 cubic feet for containing residual combustion gases and attenuating pressure waves, said columns are disposed in said main pressure chamber near the connection of said main pressure vessel to said extension pressure vessel, and said orifice plate is adjustable relative to said pressure vessel and is disposed in at least one of said main pressure chamber and said extension pressure chamber for attenuating pressure waves.

3. The gun muffler according to claim 1, wherein each of said columns extends from about a top to about a bottom of said pressure vessel.

4. The gun muffler according to claim 1, wherein said columns are comprised of steel and are substantially cylindrical.

5. The gun muffler according to claim 1, wherein said columns are filled with a particulate material.

6. The gun muffler according to claim 5, wherein the particulate material is concrete.

7. The gun muffler according to claim 1, wherein each of said columns has a diameter of about 1 foot.

8. The gun muffler according to claim 1, wherein said columns define two sets of columns formed on both sides of a central axis of said pressure vessel and an opening between said two sets of columns for allowing the projectile to pass through, wherein each set of columns is formed on a corresponding side of said sides of said central axis of said pressure vessel.

9. The gun muffler according to claim 1, wherein little space exists between said columns in the direction of travel of the particulates.

10. The gun muffler according to claim 1, wherein no space exists between said columns in the direction of travel of the particulates.

11. A noise abatement system for a large caliber gun having a gun tube, said system comprising:

a horizontal concrete slab; and a gun muffler adapted for attenuating pressure waves caused by a firing of a projectile by the gun and for being mounted on said concrete slab, said gun muffler comprising an end adapted to be coupled to the gun tube and a catcher disposed within said gun muffler for entrapping particulates and for permitting the projectile to pass, said catcher comprising a plurality of columns adapted for being removably attached within said gun muffler.

wherein said columns are in a generally parallel arrangement.

12. The noise abatement system according to claim 11, wherein said gun muffler further comprises:

a transition section fitted around the gun tube and engaging the gun tube for preventing the escape of residual combustion gases caused by the firing of the projectile by the gun, a main pressure vessel having a first end attached to said transition section and defining a main pressure chamber of about 4,000 cubic feet for containing residual combustion gases and attenuating pressure waves;

an extension pressure vessel disposed in series with and connected to said main pressure vessel and defining an extension pressure chamber of about 1,000 cubic feet for containing residual combustion gases and attenuating pressure waves; and at least one orifice plate, which is adjustable relative to said pressure vessel, disposed in at least one of said main pressure chamber and said extension pressure chamber for attenuating pressure waves, wherein said columns are disposed in said main pressure chamber near the connection of said main pressure vessel to said extension pressure vessel.

13. The noise abatement system according to claim 11, wherein each of said columns extends from about a top to about a bottom of said gun muffler.

14. The noise abatement system according to claim 11, wherein at least two of said columns are staggered relative to one another with respect to the direction along a central axis of said gun muffler.

15. The noise abatement system according to claim 11, wherein said columns are comprised of steel and are substantially cylindrical.

16. The noise abatement system according to claim 11, wherein said columns are filled with a particulate material.

17. The noise abatement system according to claim 16, wherein the particulate material is concrete.

18. The noise abatement system according to claim 11, wherein each of said columns has a diameter of about 1 foot.

19. The noise abatement system according to claim 11, wherein said columns define two sets of columns formed on both sides of a central axis of said gun muffler and an opening between said two sets of columns for allowing the projectile to pass through, wherein each set of columns is formed on a corresponding side of said sides of said central axis of said gun muffler.

20. The noise abatement system according to claim 11, wherein said concrete slab is mounted to the ground.

21. The noise abatement system according to claim 11, further comprising a plurality of support piles for mounting said concrete slab to the ground.

22. The noise abatement system according to claim 11, further comprising an arch disposed over said gun muffler.

23. The noise abatement system according to claim 11, wherein said concrete slab has a thickness of about four feet.

24. The noise abatement system according to claim 11, further comprising a projectile stop, mounted on said concrete slab and longitudinally aligned with said gun muffler, for stopping the projectile fired by the gun and for permitting the projectile to pass.

25. The noise abatement system according to claim 11, wherein little space exists between said columns in the direction of travel of the particulates.

26. The noise abatement system according to claim 11, wherein no space exists between said columns in the direction of travel of the particulates.

27. In a gun muffler for a large caliber gun having a gun tube, said gun muffler comprising a transition section fitted around the gun tube and engaging the gun tube, a main pressure vessel having a first end attached to said transition section and defining a main pressure chamber of about 4,000 cubic feet, an extension pressure vessel disposed in series with and connected to said main pressure vessel and defines an extension pressure chamber of about 1,000 cubic feet, at least one orifice plate being adjustable relative to at least one of said main pressure vessel and said extension pressure vessel and being disposed in at least one of said main pressure chamber and said extension pressure chamber, and a catcher disposed within at least one of said main pressure vessel and said extension pressure vessel for entrapping particulates and for permitting the projectile to pass, wherein the improvement comprises said catcher comprising a plurality of columns adapted for being removably attached within said main pressure chamber near the connection of said main pressure vessel to said extension pressure vessel; wherein said columns are in a generally parallel arrangement and at least two of said columns are staggered relative to one another with respect to the direction along a central axis of said pressure vessel.

28. The gun muffler according to claim 27, wherein little space exists between said columns in the direction of travel of the particulates.

29. The gun muffler according to claim 27, wherein no space exists between said columns in the direction of travel of the particulates.

* * * * *